US011738903B2

(12) United States Patent
Kick

(10) Patent No.: US 11,738,903 B2
(45) Date of Patent: Aug. 29, 2023

(54) CONTAINER APPARATUS

(71) Applicant: Merrilee Kick, Plano, TX (US)

(72) Inventor: Merrilee Kick, Plano, TX (US)

( * ) Notice: Subject to any disclaimer, the term of this patent is extended or adjusted under 35 U.S.C. 154(b) by 0 days.

(21) Appl. No.: 17/465,262

(22) Filed: Sep. 2, 2021

(65) Prior Publication Data

US 2023/0064312 A1 Mar. 2, 2023

(51) Int. Cl.

| | |
|---|---|
| ***B65D 1/02*** | (2006.01) |
| ***B65B 7/28*** | (2006.01) |
| ***B65D 41/04*** | (2006.01) |
| ***B65D 21/02*** | (2006.01) |

(52) U.S. Cl.

CPC ..... *B65D 1/0246* (2013.01); *B65B 7/2835* (2013.01); *B65D 1/0276* (2013.01); *B65D 21/0222* (2013.01); *B65D 41/04* (2013.01)

(58) Field of Classification Search

CPC ..... B65D 1/0246; B65D 1/0276; B65D 21/0222; B65D 41/04; B65B 7/2835

USPC ..... 215/43

See application file for complete search history.

(56) References Cited

U.S. PATENT DOCUMENTS

| | | | | |
|---|---|---|---|---|
| D49,555 | S | | 8/1916 | Vivaudou |
| D106,034 | S | | 9/1937 | Harrison |
| D168,471 | S | | 12/1952 | Nielsen |
| 2,745,642 | A | | 5/1956 | Hermann |
| 3,179,036 | A | | 4/1965 | Jackson |
| 3,281,024 | A | | 10/1966 | Henchert et al. |
| 3,314,569 | A | | 4/1967 | Seiferth |
| D212,525 | S | * | 10/1968 | Kneapler ..... D9/519 |
| 3,542,230 | A | | 11/1970 | Campbell et al. |
| D224,516 | S | | 8/1972 | Amberg |
| D254,716 | S | | 4/1980 | Mascia |
| 4,936,482 | A | | 6/1990 | Gallagher et al. |
| D321,319 | S | | 11/1991 | Giuseppe |

(Continued)

FOREIGN PATENT DOCUMENTS

| | | |
|---|---|---|
| HR | P20180372 A2 | 9/2019 |
| JP | 05032248 | 2/1993 |

(Continued)

OTHER PUBLICATIONS

International Search Report and Written Opinion issued by the Korean Intellectual Property Office for related International Application No. PCT/US2020/054815 dated Jan. 20, 2021, 10 pages.

(Continued)

*Primary Examiner* — Ernesto A Grano

(74) *Attorney, Agent, or Firm* — Haynes and Boone, LLP

(57) ABSTRACT

Apparatus and method(s) according to which a first container lid is sealingly engaged against a container body. Once so sealingly engaged, the container body is stacked onto a second container lid so that a first three-dimensional profile of the second container lid matingly receives a second three-dimensional profile of the container body, which second three-dimensional profile is located at an end portion of the container body opposite the first container lid. In one or more embodiments, the second container lid is identical to the first container lid. In one or more embodiments, the stackable containers have respective detachable and re-attachable container lids. In one or more embodiments, each container body and its corresponding detachable and re-attachable lid are both made of recyclable plastic.

16 Claims, 17 Drawing Sheets

(56) References Cited

U.S. PATENT DOCUMENTS

| | | | | | |
|---|---|---|---|---|---|
| D325,697 | S | | 4/1992 | Parr | |
| D340,077 | S | | 10/1993 | Turner | |
| 5,356,026 | A | | 10/1994 | Andress et al. | |
| D352,898 | S | | 11/1994 | Vacher | |
| 5,407,086 | A | | 4/1995 | Ota | |
| 5,638,982 | A | | 6/1997 | Spector | |
| D383,646 | S | | 9/1997 | Jeppesen | |
| D400,400 | S | * | 11/1998 | Hurst | D7/515 |
| 5,871,111 | A | * | 2/1999 | Pfefferkorn | D06F 39/024 |
| 5,927,499 | A | * | 7/1999 | Vesborg | B65D 71/06 220/666 |
| D435,794 | S | | 1/2001 | Schmidt | |
| D437,226 | S | | 2/2001 | Sadeghi | |
| D448,666 | S | | 10/2001 | Fields | |
| D449,990 | S | | 11/2001 | Odet | |
| D460,693 | S | * | 7/2002 | Flowers | D9/519 |
| 6,574,883 | B2 | * | 6/2003 | Giblin | D06F 39/024 68/17 R |
| D479,995 | S | | 9/2003 | Duceppe | |
| D487,697 | S | * | 3/2004 | Rosen | D9/519 |
| 6,793,094 | B2 | | 9/2004 | Turnbough | |
| D512,917 | S | | 12/2005 | Frisch et al. | |
| 7,051,892 | B1 | | 5/2006 | O'Day | |
| D561,043 | S | * | 2/2008 | Lepoitevin | D9/519 |
| D562,134 | S | | 2/2008 | Studee | |
| D562,685 | S | * | 2/2008 | Millspaw | D9/500 |
| D565,413 | S | | 4/2008 | Honkawa et al. | |
| D596,489 | S | * | 7/2009 | Weiss | D9/519 |
| D606,404 | S | | 12/2009 | Diss | |
| D606,405 | S | | 12/2009 | Takata et al. | |
| D612,732 | S | | 3/2010 | Takata et al. | |
| D614,971 | S | | 5/2010 | Millspaw et al. | |
| 7,731,053 | B2 | | 6/2010 | Ivey | |
| D634,635 | S | | 3/2011 | Araujo et al. | |
| D648,217 | S | * | 11/2011 | Fahey | D9/519 |
| D650,280 | S | * | 12/2011 | de Peyerimhoff | D9/519 |
| D658,061 | S | | 4/2012 | Furlan | |
| D663,619 | S | * | 7/2012 | Pillet | D9/503 |
| D675,102 | S | * | 1/2013 | Crowe | D9/554 |
| D675,528 | S | * | 2/2013 | Beaver | D9/551 |
| D699,578 | S | * | 2/2014 | Marina | D9/519 |
| D701,767 | S | * | 4/2014 | Marina | D9/500 |
| D703,068 | S | * | 4/2014 | Kick | D9/776 |
| D704,567 | S | * | 5/2014 | Sanders | D9/519 |
| D705,077 | S | | 5/2014 | Martin | |
| D710,153 | S | * | 8/2014 | Marini | D7/901 |
| D711,247 | S | * | 8/2014 | Sanders | D9/519 |
| D721,585 | S | * | 1/2015 | Gonzalez Rodriguez | D9/519 |
| D732,978 | S | * | 6/2015 | Kick | D9/772 |
| D739,259 | S | * | 9/2015 | Sanders | D9/519 |
| D739,267 | S | * | 9/2015 | Kick | D9/776 |
| D749,368 | S | * | 2/2016 | Risso | D9/503 |
| 9,278,781 | B1 | * | 3/2016 | Boldis | B65D 21/0231 |
| D772,709 | S | | 11/2016 | Kick | |
| D772,722 | S | * | 11/2016 | Kick | D9/551 |
| D809,391 | S | * | 2/2018 | Funk | D9/519 |
| D820,106 | S | * | 6/2018 | Jasani | D9/600 |
| 10,604,296 | B2 | | 3/2020 | Kick | |
| 11,148,847 | B2 | * | 10/2021 | Bueti | B65D 41/3428 |
| D934,688 | S | * | 11/2021 | Whittington | D9/503 |
| 2007/0187277 | A1 | | 8/2007 | Furlong | |
| 2008/0245757 | A1 | * | 10/2008 | Durand | B65D 1/42 215/47 |
| 2011/0068079 | A1 | | 3/2011 | Luzatto et al. | |
| 2011/0253720 | A1 | * | 10/2011 | Kick | B65D 17/4012 220/608 |
| 2012/0018337 | A1 | * | 1/2012 | Furey | B65D 21/0231 206/520 |
| 2013/0240401 | A1 | * | 9/2013 | Hall | B65D 23/102 220/601 |
| 2014/0027336 | A1 | * | 1/2014 | Bou Mezrag | B65D 21/023 206/519 |
| 2014/0061150 | A1 | * | 3/2014 | Park | B65D 21/0231 215/44 |
| 2014/0061328 | A1 | * | 3/2014 | Haymond | B65D 43/02 239/6 |
| 2015/0190003 | A1 | | 7/2015 | Kelaher et al. | |
| 2015/0344177 | A1 | * | 12/2015 | Kick | B65D 85/72 206/505 |
| 2018/0271327 | A1 | | 9/2018 | Haskins | |
| 2020/0262601 | A1 | | 8/2020 | Kick | |
| 2021/0107111 | A1 | | 4/2021 | Kick | |

FOREIGN PATENT DOCUMENTS

| | | | |
|---|---|---|---|
| JP | 31608809 | S | 7/2021 |
| KR | 20-2010-0010225 | U | 10/2010 |
| KR | 20-0467746 | Y1 | 7/2013 |
| KR | 3006720360000 | S | 1/2014 |
| KR | 10-1518718 | B1 | 5/2015 |
| KR | 10-2017-0091122 | A | 8/2017 |
| TW | D180616 | S | 1/2017 |

OTHER PUBLICATIONS

Translation of Office Action with Search Report for Taiwanese Design Patent Application No. 111301016, dated Aug. 31, 2022; 3 pages.

International Search Report and Written Opinion for corresponding International Application No. PCT/US22/75632, dated Jan. 27, 2023; 13 pages.

* cited by examiner

CONTAINER APPARATUS

CROSS-REFERENCE TO RELATED APPLICATION

This application is related to U.S. application Ser. No. 29/806,332 ("the '332 Application"), filed Sep. 2, 2021, the entire disclosure of which is hereby incorporated herein by reference.

TECHNICAL FIELD

The present application relates generally to containers, and, more particularly, to stackable containers having detachable and re-attachable lids.

BRIEF DESCRIPTION OF THE DRAWINGS

FIG. 2C-1 is a front view of a portion of the container body of FIG. 1, according to one or more embodiments.

FIG. 2C-2 is a rear view of the portion of the container body of FIG. 2C-1, according to one or more embodiments.

FIG. 3C-1 is a cross-sectional view of the container lid of FIG. 1 taken along the line 3C-1-3C-1 of FIG. 3B, according to one or more embodiments.

FIG. 3C-2 is a cross-sectional view of the container lid of FIG. 1 taken along the line 3C-2-3C-2 of FIG. 3B, according to one or more embodiments.

DETAILED DESCRIPTION

Figure 1:
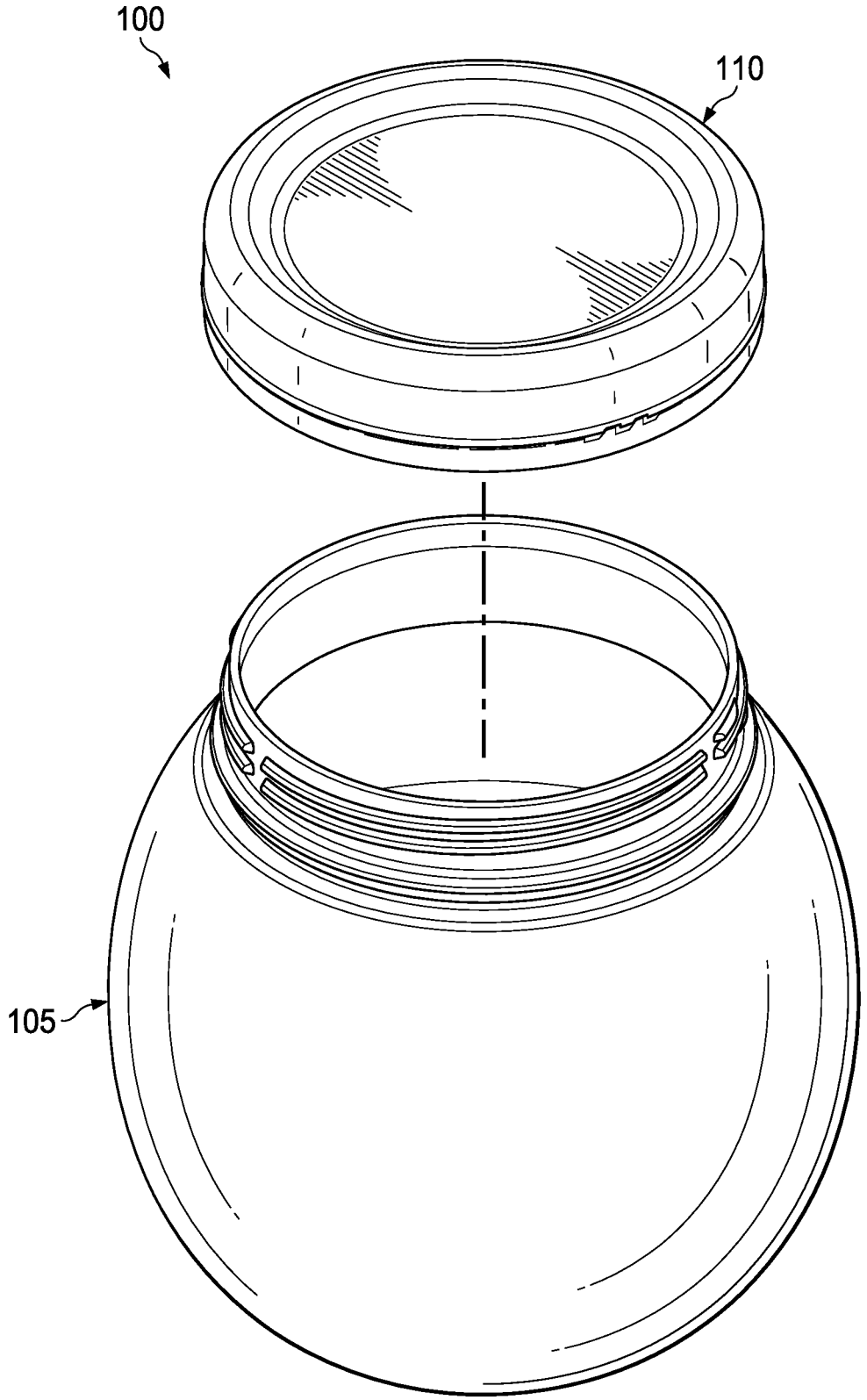
FIG. 1 is a top-front-left perspective view of a first container apparatus in a first operational state or configuration, the first container apparatus including a container body and a container lid, according to one or more embodiments.

Referring to FIG. 1, in an embodiment, a container apparatus is generally referred to by the reference numeral 100. The container apparatus 100 includes a container body 105 and a container lid 110.

Referring to FIGS. 2A through 2F, in an embodiment, the container body 105 extends along a central axis 115 and defines an internal cavity 120. The container body 105 includes a side wall 125, a neck 130, and a bottom wall 135. The side wall 125 is frustospherical or frustospheroidal, that is, in the shape of a truncated sphere or a truncated spheroid (i.e., a sphere-like but not perfectly spherical body). In addition, or instead, the side wall 125 (or a portion thereof) may be or include another curved shape, a cylindrical shape, a tapered shape (e.g., a frustoconical shape), another shape, or a combination thereof. The side wall 125 defines axially opposing end portions 140*a* and 140*b*. In one or more embodiments, the side wall 125 defines a radius of curvature R1 (shown in FIG. 2F), at least at the end portion 140*b*. In addition, or instead, at least a portion of the end portion 140*b* of the side wall 125 may be frustoconical. In combination, the end portion 140*b* of the side wall 125 and the bottom wall 135 of the container body 105 define, and may be referred to herein as, a "three-dimensional profile"; this three-dimensional profile mirrors another three-dimensional profile defined by the container lid 110, as will be described in further detail below. In one or more embodiments, the neck 130 is cylindrical. The neck 130 defines an outer diameter D1, axially opposing end portions 145*a* and 145*b*, and a mouth 150 via which the internal cavity 120 of the container body 105 is accessible. The end portion 145*b* of the neck 130 is connected to the side wall 125 at the end portion 145*a* of the side wall 125. An external collar 155 extends around the neck 130 and outwardly therefrom. External threads 160*a-b* also extend around the neck 130. The external threads 160*a-b* are positioned relatively farther from the side wall 125 than the external collar 155.

Figure 2A:
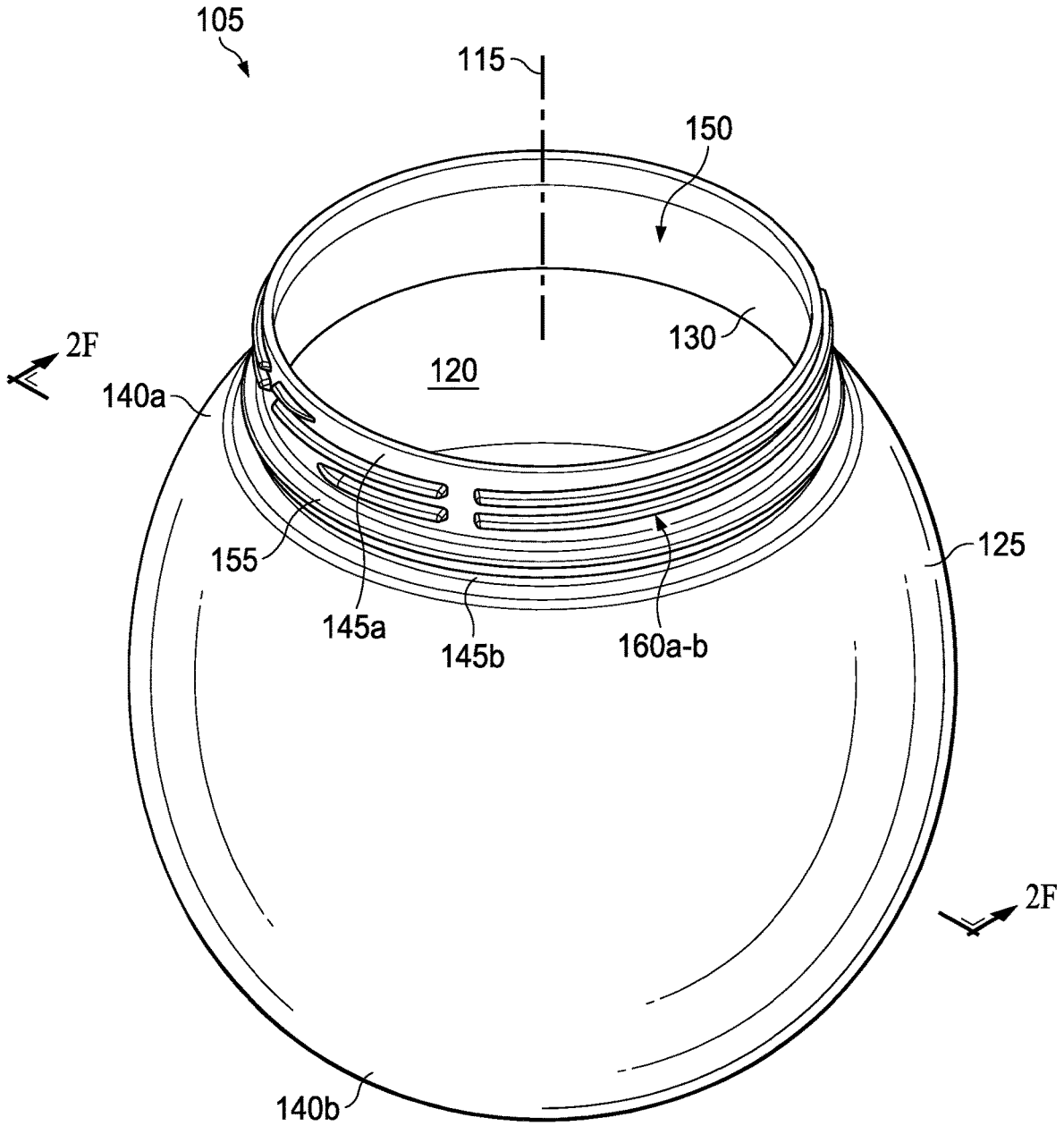
FIG. 2A is a top-front-left perspective view of the container body of FIG. 1, according to one or more embodiments.
Figure 2B:
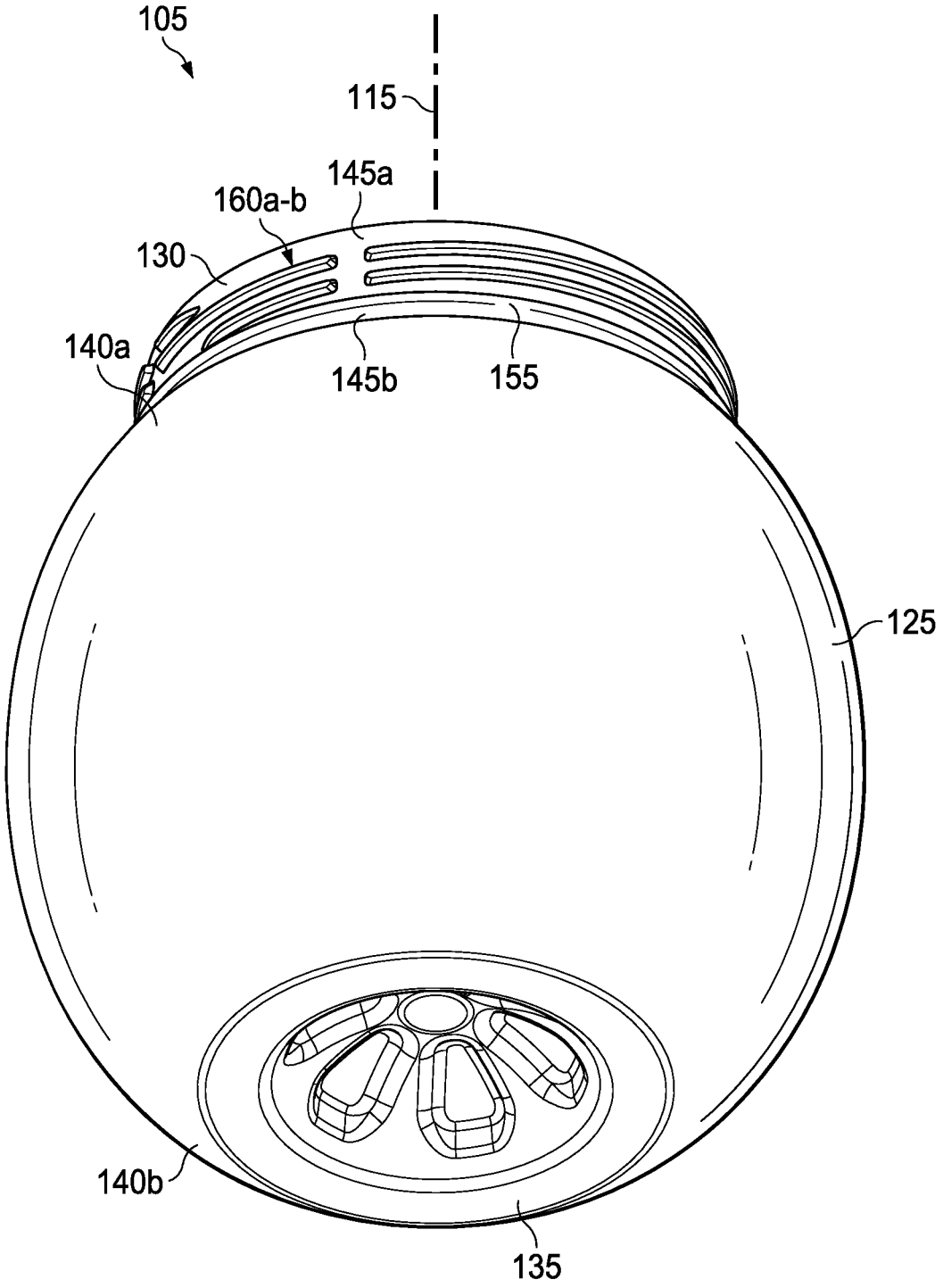
FIG. 2B is a bottom-rear-right perspective view of the container body of FIG. 1, according to one or more embodiments.
Figures 1, 2C:
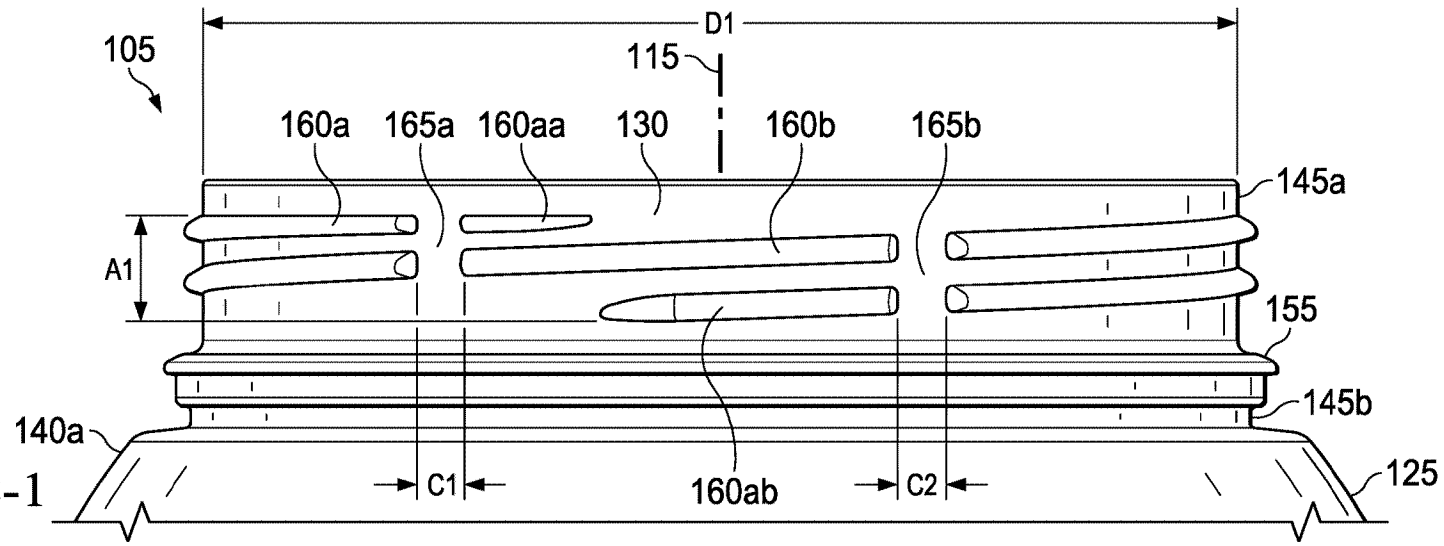

As shown in FIG. 2C-1, the external thread 160*a* defines circumferentially opposing end portions 160*aa* and 160*ab*. The end portions 160*aa* and 160*ab* of the thread 160*a* are each tapered. Moreover, the external thread 160*a* extends spirally around the neck 130, causing the circumferentially opposing end portions 160*aa* and 160*ab* to be axially spaced apart from each other by a gap having an axial dimension A1. The end portion 160*aa* of the thread 160*a* extends relatively closer to the end portion 145*a* of the neck 130 than the end portion 160*ab* of the thread 160*a*, and the end portion 160*ab* of the thread 160*a* extends relatively closer to the end portion 145*b* of the neck 130 than the end portion 160*aa* of the thread 160*a*. The external thread 160*b* extends through the gap between the end portions 160*aa* and 160*ab* of the thread 160*a*.

Figures 2, 2C:
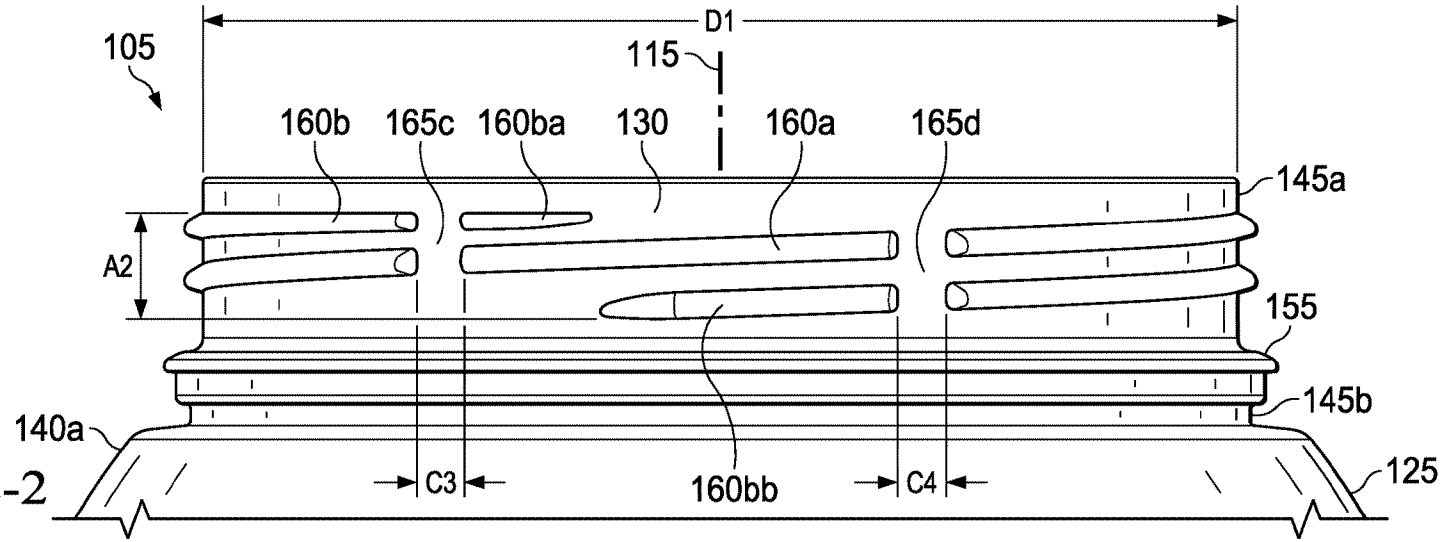

As shown in FIG. 2C-2, the external thread 160*b* defines circumferentially opposing end portions 160*ba* and 160*bb*. The end portions 160*ba* and 160*bb* of the thread 160*b* are each tapered. Moreover, the external thread 160*b* extends spirally around the neck 130, causing the circumferentially opposing end portions 160*ba* and 160*bb* to be axially spaced apart from each other by a gap having an axial dimension A2. In one or more embodiments, the axial dimensions A1 and A2 are the same. The end portion 160*ba* of the thread 160*b* extends relatively closer to the end portion 145*a* of the neck 130 than the end portion 160*bb* of the thread 160*b*, and the end portion 160*bb* of the thread 160*b* extends relatively closer to the end portion 145*b* of the neck 130 than the end portion 160*ba* of the thread 160*b*. The external thread 160*a* extends through the gap between the end portions 160*ba* and 160*bb* of the thread 160*b*.

Figure 2D:
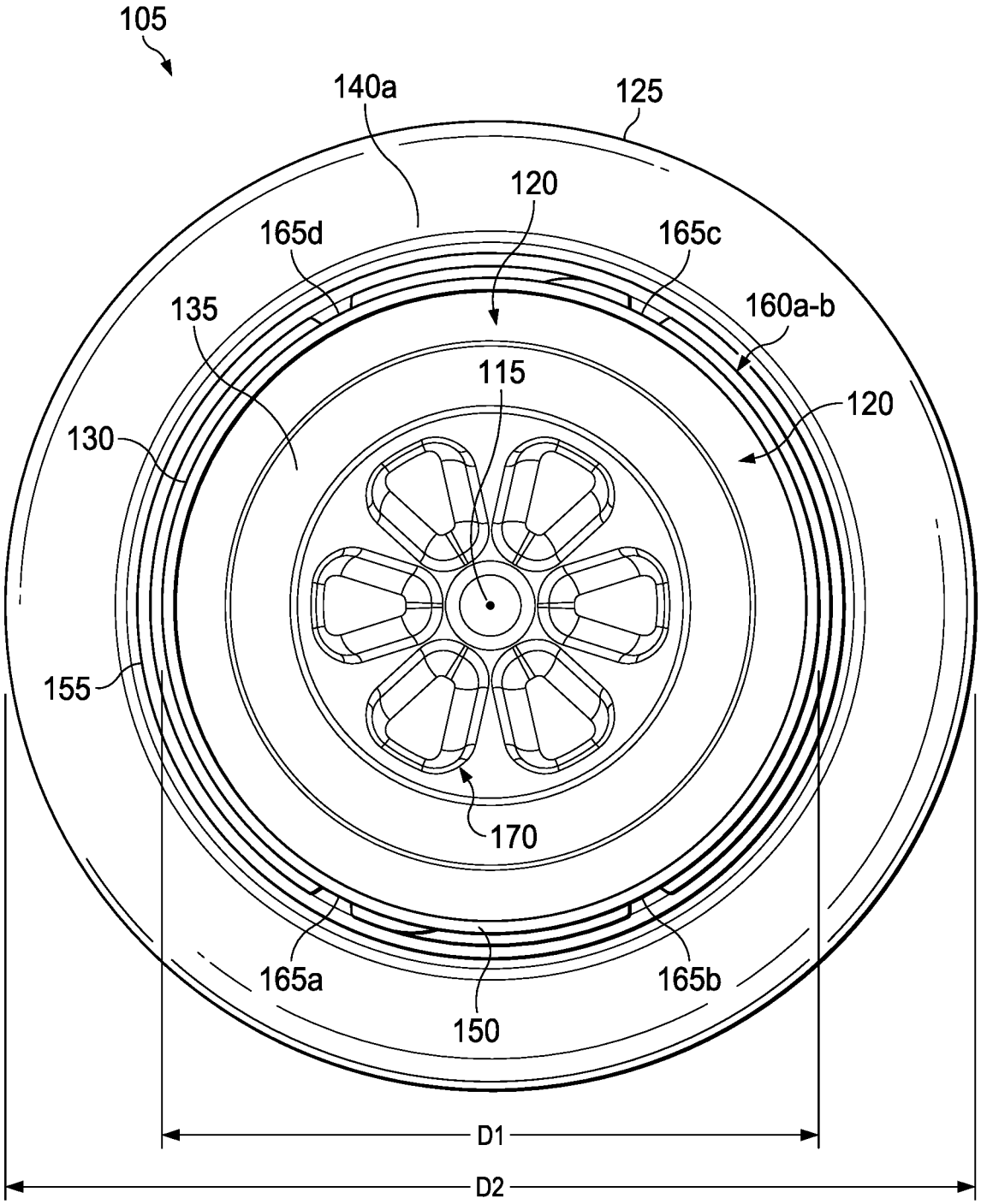
FIG. 2D is a top view of the container body of FIG. 1, according to one or more embodiments.

As shown in FIGS. 2C-1 and 2D, a pair of circumferentially-spaced gaps 165*a-b* are formed axially through the external threads 160*a-b* and exteriorly along the neck 130. More particularly, the gap 165*a* defines a circumferential dimension C1, and is formed exteriorly along the neck 130, and axially through: the end portion 160*aa* of the external thread 160*a*; and a medial portion of the external thread 160*b* between the opposing end portions 160*ba* and 160*bb*. Likewise, the gap 165*b* defines a circumferential dimension C2, and is formed exteriorly along the neck 130 and axially through; a medial portion of the external thread 160*b* between the opposing end portions 160*ba* and 160*bb*; and the end portion 160*ab* of the external thread 160*a*. In one or more embodiments, the circumferential dimensions C1 and C2 are the same.

As shown in FIGS. 2C-2 and 2D, a pair of circumferentially-spaced gaps 165*c-d* are formed axially through the external threads 160*a-b* and exteriorly along the neck 130. More particularly, the gap 165*c* defines a circumferential dimension C3, and is formed exteriorly along the neck 130, and axially through: the end portion 160*ba* of the external thread 160*b*; and a medial portion of the external thread 160*a* between the opposing end portions 160*aa* and 160*ab*. Likewise, the gap 165*d* defines a circumferential dimension C4, and is formed exteriorly along the neck 130 and axially through; a medial portion of the external thread 160*a* between the opposing end portions 160*aa* and 160*ab*; and the end portion 160*bb* of the external thread 160*b*. In one or more embodiments, the circumferential dimensions C3 and C4 are the same. In one or more embodiments, the circumferential dimensions C1, C2, C3, and C4 are the same.

Figure 2E:
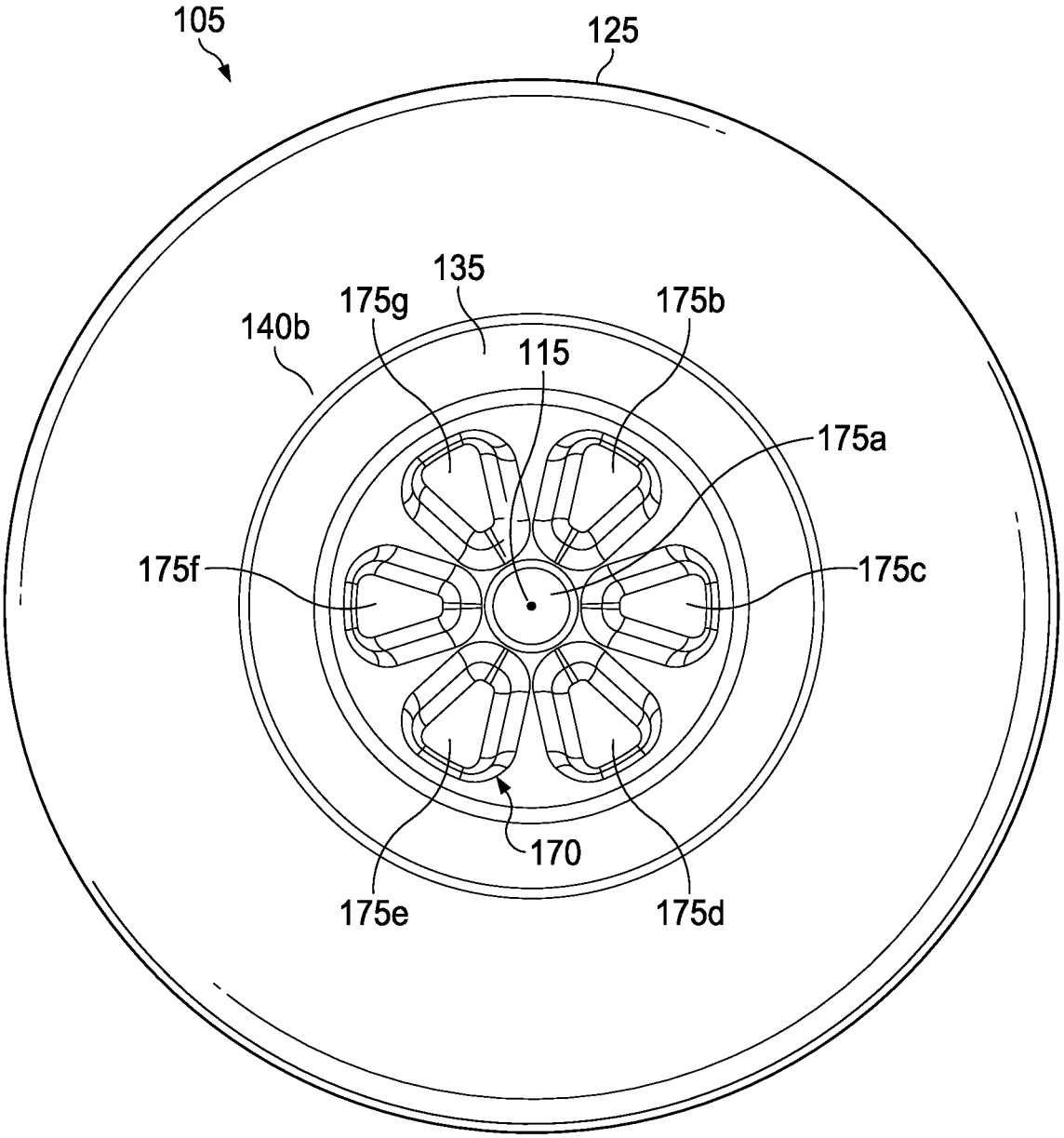
FIG. 2E is a bottom view of the container body of FIG. 1, according to one or more embodiments.

As shown in FIG. 2E, the bottom wall 135 is connected to the side wall 125 at the end portion 140*b* of the side wall 125. An external indentation pattern 170 is formed into the bottom wall 135. The external indentation pattern 170 includes a central indentation 175*a* and petal indentations 175*b-g* distributed (e.g., evenly) around the central indentation 175*a*.

Figure 2F:
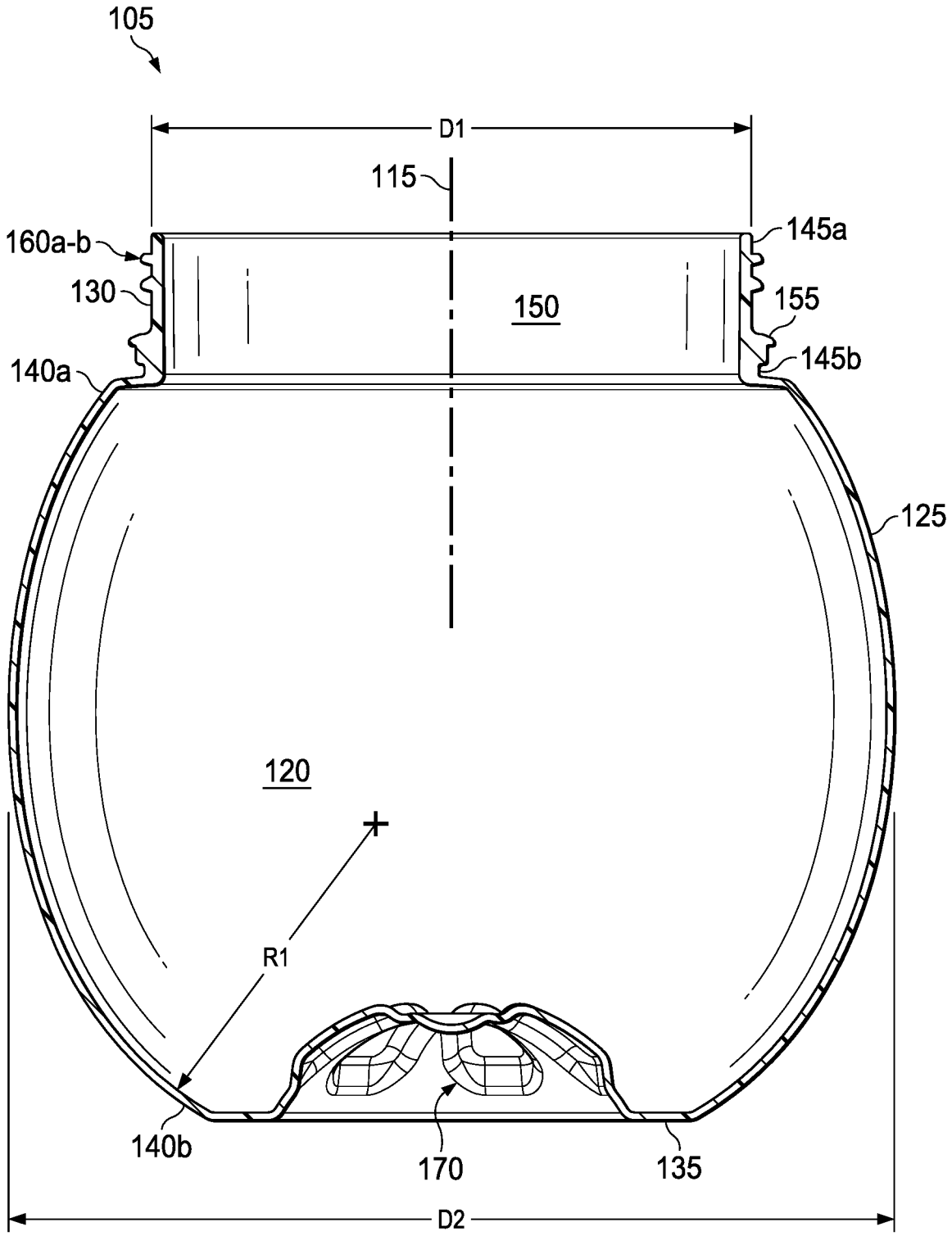
FIG. 2F is a cross-sectional view of the container body of FIG. 1 taken along the line 2F-2F of FIG. 2A, according to one or more embodiments.

As shown in FIGS. 2D and 2F, the side wall 125 of the container body 105 defines a maximum outer diameter D2. In one or more embodiments, the first ratio of the outer diameter D1 of the neck 130 to the outer diameter D2 of the side wall 125 exceeds a threshold, or is within a range, that makes it difficult (at least more so than in conventional container-lid-to-container-body-arrangements) to seal gas pressure within the internal cavity 120 of the container body 110 from atmosphere; this difficulty is addressed and overcome by various feature(s)/component(s) of the container body 105 and the container lid 110, which feature(s)/component(s) will be discussed in further detail below.

For example, in one or more embodiments, a first ratio of the outer diameter D1 of the neck 130 to the outer diameter D2 of the side wall 125 is greater than or equal to 1:2. For another example, in one or more embodiments, the first ratio of the outer diameter D1 of the neck 130 to the outer diameter D2 of the side wall 125 is greater than or equal to 1:2 and less than or equal to 7:8. For yet another example, in one or more embodiments, the first ratio of the outer diameter D1 of the neck 130 to the outer diameter D2 of the side wall 125 is greater than or equal to 1:2 and less than or equal to 3:4. For yet another example, in one or more embodiments, the first ratio of the outer diameter D1 of the neck 130 to the outer diameter D2 of the side wall 125 is greater than or equal to 2:3. For yet another example, in one or more embodiments, the first ratio of the outer diameter D1 of the neck 130 to the outer diameter D2 of the side wall 125 is greater than or equal to 2:3 and less than or equal to 7:8. For yet another example, in one or more embodiments, the first ratio of the outer diameter D1 of the neck 130 to the outer diameter D2 of the side wall 125 is greater than or equal to 2:3 and less than or equal to 3:4.

In one or more embodiments, the container body 105 is made of an appropriate plastic/synthetic resin, such as, for example, polyethylene terephthalate (PET) resin. In addition, or instead, the container body 105 may be or include polyamide resin, polycarbonate resin, polyacetal resin, polybuthylene terephthalate resin, another synthetic resin having a sufficient resistance to chemicals, the like, or any combination thereof. In one or more embodiments, the container body 105 is made of recyclable plastic. In one or more embodiments, the container body 105 may be formed by molding process(es), such as, for example, biaxial orientation blow molding process(es), direct blow molding process(es), injection blow molding process(es), other molding process(es), the like, or any combination thereof.

Referring to FIGS. 3A through 3D, in an embodiment, the container lid 110 extends along a central axis 180 and includes a side wall 185 and a top wall 190. In one of more embodiments, the side wall 185 is cylindrical. The side wall 185 defines an inner diameter D3 and axially opposing end portions 195*a* and 195*b*. The inner diameter D3 of the side wall 185 is equal to or greater than the outer diameter D1 of the neck 130. Internal ridges, or internal threads 200*a-b*, extend circumferentially along the side wall 185. In one or more embodiments, the second ratio of the inner diameter D3 of the side wall 185 of the container lid 110 to the outer diameter D2 of the side wall 125 of the container body 105 exceeds a threshold, or is within a range, that makes it difficult (at least more so than in conventional container-lid-to-container-body-arrangements) to seal gas pressure within the internal cavity 120 of the container body 110 from atmosphere; this difficulty is addressed and overcome by various feature(s)/component(s) of the container body 105 and the container lid 110, which feature(s)/component(s) will be discussed in further detail below.

For example, in one or more embodiments, a second ratio of the inner diameter D3 of the side wall 185 of the container lid 110 to the outer diameter D2 of the side wall 125 of the container body 105 is greater than or equal to 1:2. For another example, in one or more embodiments, the second ratio of the inner diameter D3 of the side wall 185 of the container lid 110 to the outer diameter D2 of the side wall 125 of the container body 105 is greater than or equal to 1:2 and less than or equal to 7:8. For yet another example, in one or more embodiments, the second ratio of the inner diameter D3 of the side wall 185 of the container lid 110 to the outer diameter D2 of the side wall 125 of the container body 105 is greater than or equal to 1:2 and less than or equal to ¾. For yet another example, in one or more embodiments, the second ratio of the inner diameter D3 of the side wall 185 of the container lid 110 to the outer diameter D2 of the side wall 125 of the container body 105 is greater than or equal to 2:3. For yet another example, in one or more embodiments, the second ratio of the inner diameter D3 of the side wall 185 of the container lid 110 to the outer diameter D2 of the side wall 125 of the container body 105 is greater than or equal to 2:3 and less than or equal to 7:8. For yet another example, in one or more embodiments, the second ratio of the inner diameter D3 of the side wall 185 of the container lid 110 to the outer diameter D2 of the side wall 125 of the container body 105 is greater than or equal to 2:3 and less than or equal to 3:4.

Figure 3A:
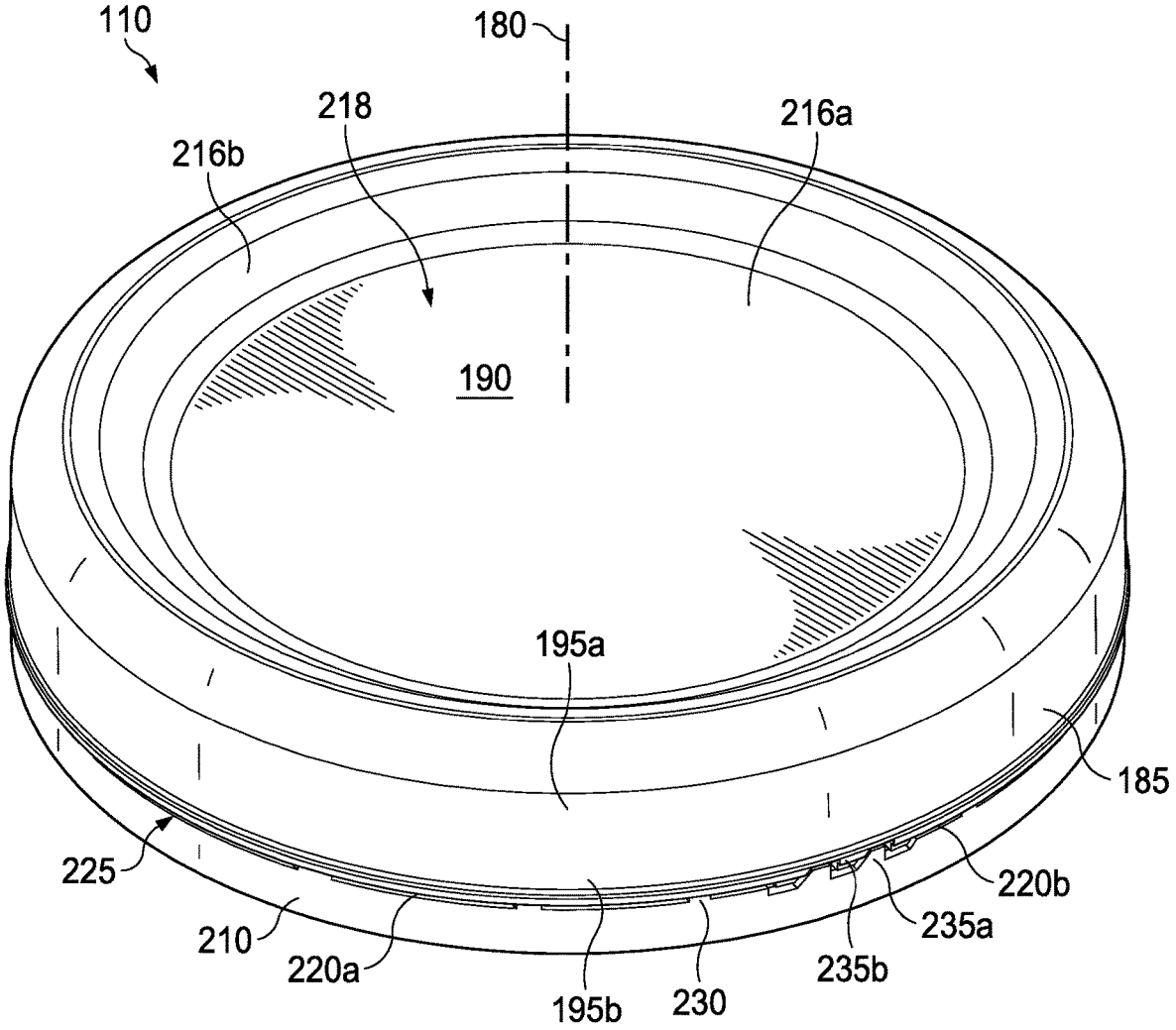
FIG. 3A is a top-front-left perspective view of the container lid of FIG. 1, according to one or more embodiments.
Figure 3B:
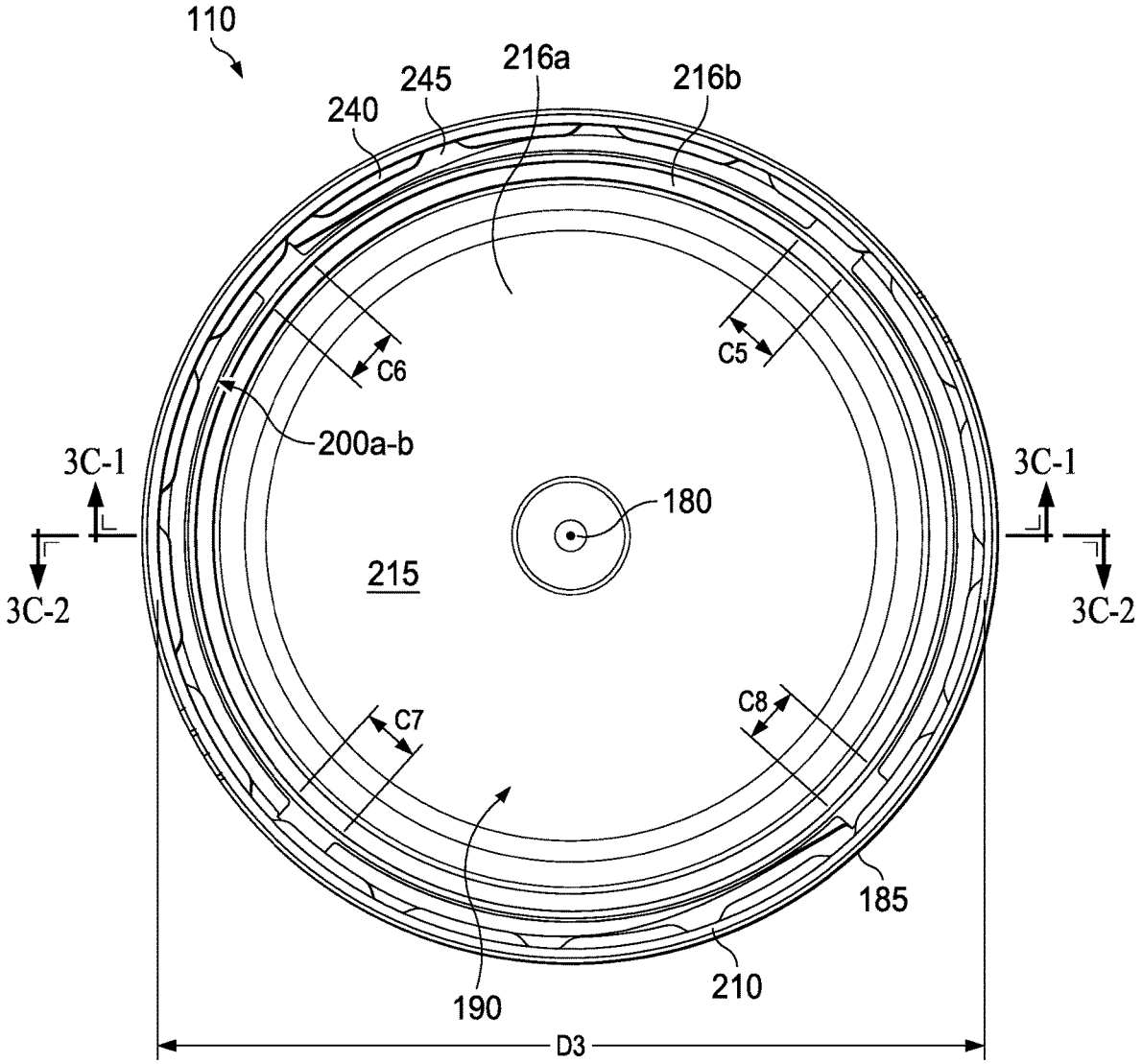
FIG. 3B is a bottom view of the container lid of FIG. 1, according to one or more embodiments.
Figures 1, 3C:
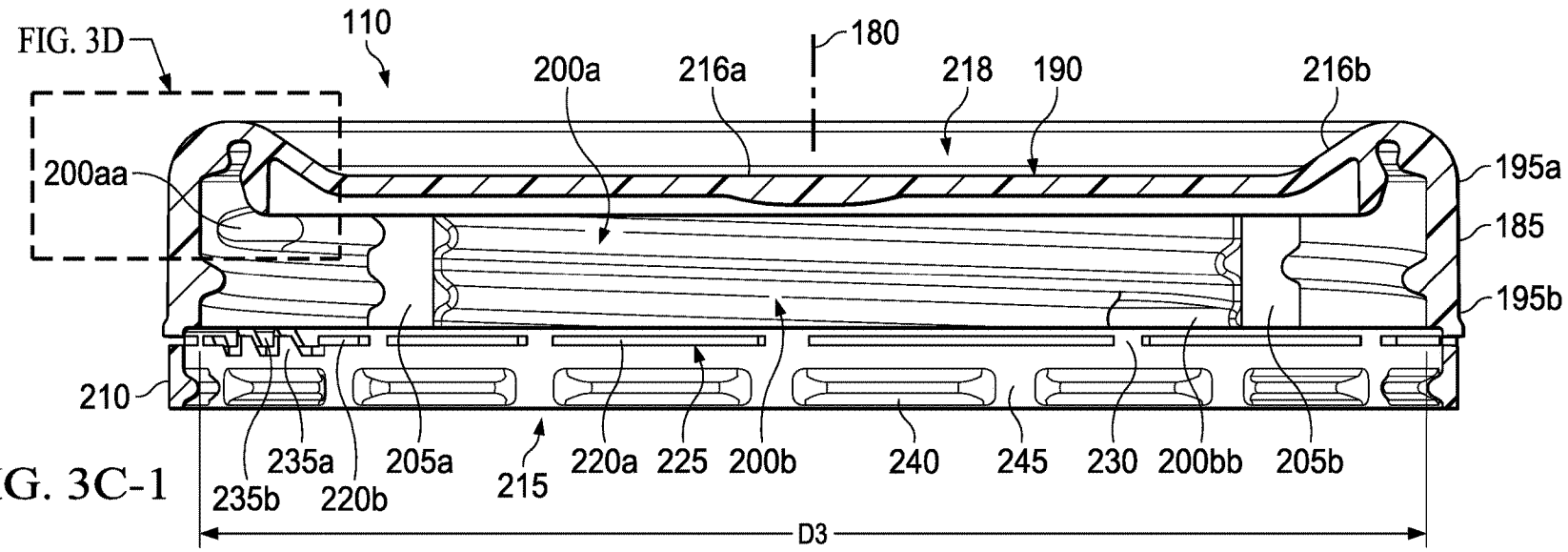
Figures 2, 3C:
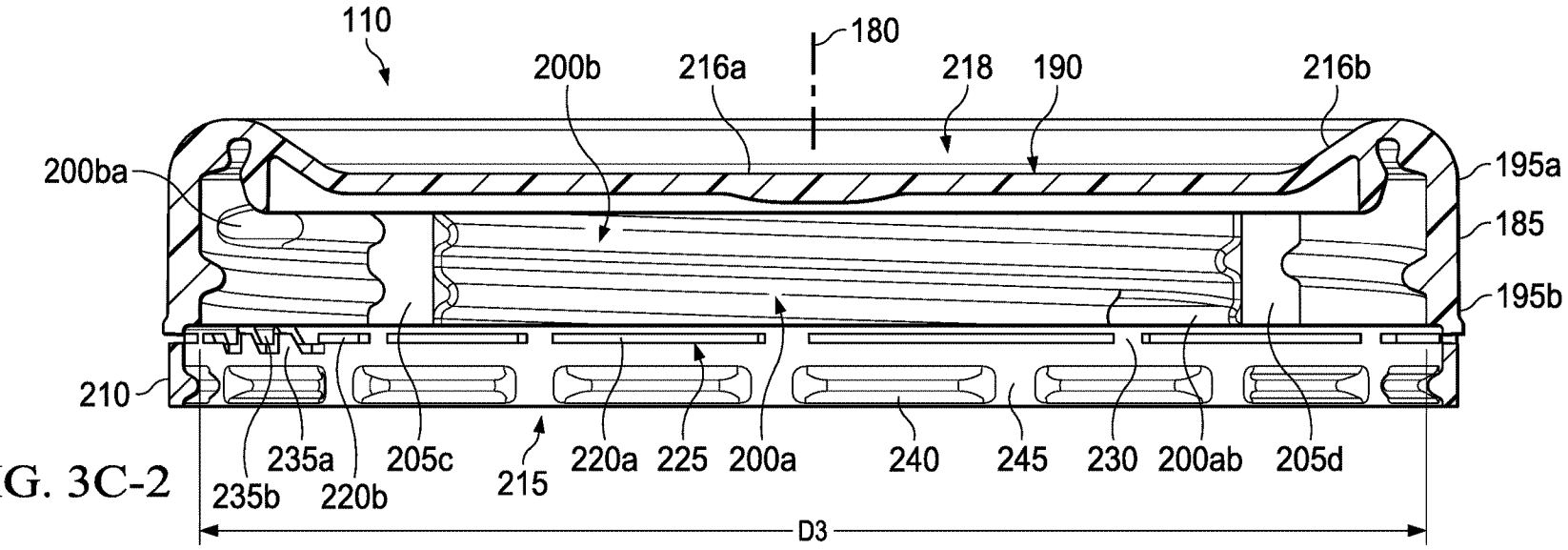

As shown in FIGS. 3C-1 and 3C-2, the internal thread 200*a* defines circumferentially opposing end portions 200*aa* (visible in FIG. 3C-1) and 200*ab* (visible in FIG. 3C-2). The end portions 200*aa* and 200*bb* of the thread 200*a* are each tapered. Moreover, the internal thread 200*a* extends spirally along the side wall 185, causing the circumferentially opposing end portions 200*aa* and 200*ab* to be axially and circumferentially spaced apart from each other. The end portion 200*aa* of the thread 200*a* extends relatively closer to the end portion 195*a* of the side wall 185 than the end portion 200*ab* of the thread 200*a*, and the end portion 200*ab* of the thread 200*a* extends relatively closer to the end portion 195*b* of the side wall 185 than the end portion 200*aa* of the thread 200*a*.

Likewise, the internal thread 200*b* defines circumferentially opposing end portions 200*ba* (visible in FIG. 3C-2) and 200*bb* (visible in FIG. 3C-1). The end portions 200*ba* and 200*bb* of the thread 200*b* are each tapered. Moreover, the internal thread 200*b* extends spirally along the side wall 185, causing the circumferentially opposing end portions 200*ba* and 200*bb* to be axially and circumferentially spaced apart from each other. The end portion 200*ba* of the thread 200*b* extends relatively closer to the end portion 195*a* of the side wall 185 than the end portion 200*bb* of the thread 200*b*, and the end portion 200*bb* of the thread 200*b* extends relatively closer to the end portion 195*b* of the side wall 185 than the end portion 200*ba* of the thread 200*b*.

As shown in FIGS. 3B, 3C-1, and 3C-2, a plurality of circumferentially-spaced gaps 205*a-d* are formed axially through the internal threads 200*a-b* and radially into the side wall 185. More particularly, the gap 205*a* defines a circumferential dimension C5, and is formed radially into, and interiorly along, the side wall 185, and axially through: the end portion 200*aa* of the internal thread 200*a*; and a medial portion of the internal thread 200*b* between the opposing end portions 200*ba* and 200*bb*.

The gap 205*b* defines a circumferential dimension C6, and is formed radially into, and interiorly along, the side wall 185, and axially through: a medial portion of the external thread 200*b* between the opposing end portions 200*ba* and 200*bb*. Optionally, the gap 205*b* may also be formed axially through the end portion 200*bb* of the internal thread 200*b*. In one or more embodiments, the circumferential dimensions C5 and C6 are the same.

The gap 205*c* defines a circumferential dimension C7, and is formed radially into, and interiorly along, the side wall 185, and axially through: the end portion 200*ba* of the internal thread 200*b*; and a medial portion of the internal thread 200*a* between the opposing end portions 200*aa* and 200*ab*. In one or more embodiments, the circumferential dimension C7 is the same as the circumferential dimension C5, the circumferential dimension C6, or both.

The gap 205*d* defines a circumferential dimension C8, and is formed radially into, and interiorly along, the side wall 185, and axially through: a medial portion of the external thread 200*b* between the opposing end portions 200*ba* and 200*bb*. Optionally, the gap 205*d* may also be formed axially through the end portion 200*ab* of the internal thread 200*a*. In one or more embodiments, the circumferential dimension C8 is the same as the circumferential dimension C5, the circumferential dimension C6, the circumferential dimension C7, or any combination thereof.

As shown in FIGS. 3A, 3C-1, and 3C-2, the top wall 190 is connected to the side wall 185 at the end portion 195*a* of the side wall 185. A security band 210 is detachably connected to the side wall 185 at the end portion 195*b* of the side wall 185. As a result, the side wall 185, the top wall 190, and the security band 210, in combination, define an internal region 215. The top wall 190 includes a central portion 216*a* and an outer edge portion 216*b*. In one or more embodiments, at least a portion of the central portion 216*a* is planar. In one or more embodiments, the outer edge portion 216*b* extends circumferentially. The outer edge portion 216*b* connects the central portion 216*a* to the end portion 195*a* of the side wall 185. The central portion 216*a* and at least a portion of the outer edge portion 216*b*, in combination, define an external concavity 218 of the container lid 110.

Perforations 220*a-b* are formed radially through the container lid 110, at a circumferential border 225 between the security band 210 and the end portion 195*b* of the side wall 185, leaving separable segments 230 interposed between the perforations 220*a-b*, which separable segments 230 detachably connect the security band 210 to the end portion 195 of the side wall 185. The perforations 220*a* are straight. In contrast, the perforations 220*b* are jagged, forming opposing ramps 235*a-b* in the security band 210 and the side wall 185, respectively. In one or more embodiments, the perforations 220*a-b* include ten (10) straight perforations 220*a* and two (2) jagged perforations 220*b*, with the two (2) jagged perforations 220*b* circumferentially opposing each other so that five (5) of the straight perforations 220*a* extend circumferentially between the two (2) jagged perforations 220*b* on one side of the container lid 110, and the other five (5) of the straight perforations 220*a* extending circumferentially between the two (2) jagged perforations 220*b* on the other side of the container lid 110.

As shown in FIGS. 3B, 3C-1, and 3C-2, internal ridges 240 extend radially inwardly from the security band 210, leaving gaps 245 interposed therebetween. In one or more embodiments, the container security band 210 includes ten (14) of the circumferentially-spaced internal ridges 240.

Figure 3D:
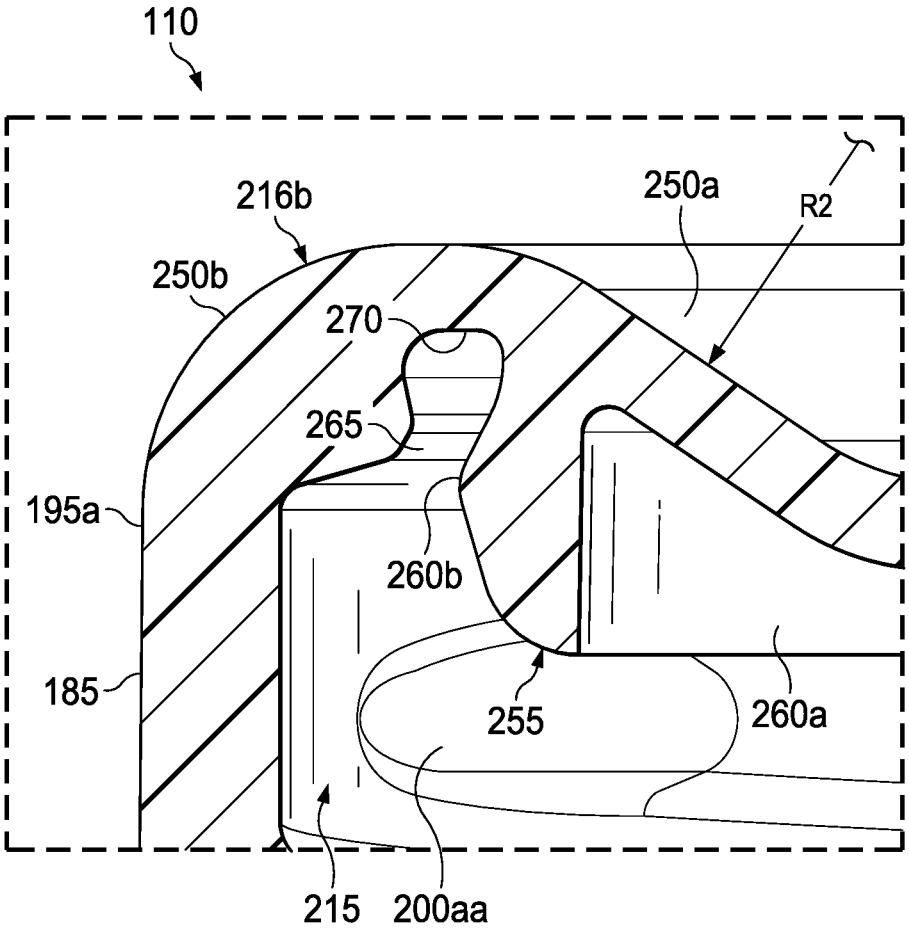
FIG. 3D is an enlarged cross-sectional view of a portion of the container lid of FIG. 3C-1, according to one or more embodiments.

As shown in FIG. 3D, the outer edge portion 216*b* of the top wall 190 includes external surfaces 250*a-b*. The external surface 250*a* extends circumferentially, faces radially inwardly, and, in combination with the central portion 216*a* of the top wall 190, defines the external concavity 218 of the container lid 110. In one or more embodiments, at least a portion of the external surface 250*a* is curved. For example, the at least a portion of the external surface 250*a* may define a radius of curvature R2 (shown in FIG. 3D), which radius of curvature R2 is the same as the radius of curvature R1. In addition, or instead, at least a portion of the external surface 250*a* may be frustoconical. In combination, the central portion 216*a* of the top wall 190 of the container lid 110 and the external surface 250*a* of the outer edge portion 216*b* of the top wall 190 of the container lid 110 define, and may be referred to herein as, a "three-dimensional profile"; this three-dimensional profile mirrors the three-dimensional profile defined by the container body 105, as described in detail above.

The external surface 250*b* extends circumferentially and faces radially outwardly. In one or more embodiments, at least a portion of the external surface 250*b* is curved. An internal collar 255 extends inwardly from the outer edge portion 216*b* of the top wall 190, opposite the external surface 250*a*, and into the internal region 215. The internal collar 255 extends circumferentially and includes an internal surface 260*a* and an external bulbous protrusion 260*b*. In one or more embodiments, the internal surface 260*a* is cylindrical. An internal ridge 265 extends inwardly from the outer edge portion 216*b* of the top wall 190, opposite the external surface 250*b*, and into the internal region 215. In addition, or instead, the internal ridge 265 may extend inwardly from the side wall 185 of the container lid 110. The internal ridge 265 extends circumferentially, and, in combination with the internal collar 255, defines an internal annular groove 270 of the container lid 110 (i.e., the internal annular groove 270 extends between the internal collar 255 and the internal ridge 265).

In one or more embodiments, the container lid 110 is made of the same resin material as the container body 105. Alternatively, the container lid 110 may be made of a different resin material than the container body 105. In one or more embodiments, the container lid 110 is made of an appropriate plastic/synthetic resin, such as, for example, polyethylene terephthalate (PET) resin. In addition, or instead, the container lid 110 may be or include polyamide resin, polycarbonate resin, polyacetal resin, polybuthylene terephthalate resin, another synthetic resin having a sufficient resistance to chemicals, the like, or any combination thereof. In one or more embodiments, the container lid 110 is made of recyclable plastic. In one or more embodiments, the container lid 110 and the container body 105 are both made of recyclable plastic. In one or more embodiments, the container lid 110 may be formed by molding process(es), such as, for example, biaxial orientation blow molding process(es), direct blow molding process(es), injection blow molding process(es), other molding process(es), the like, or any combination thereof.

Figure 4A:
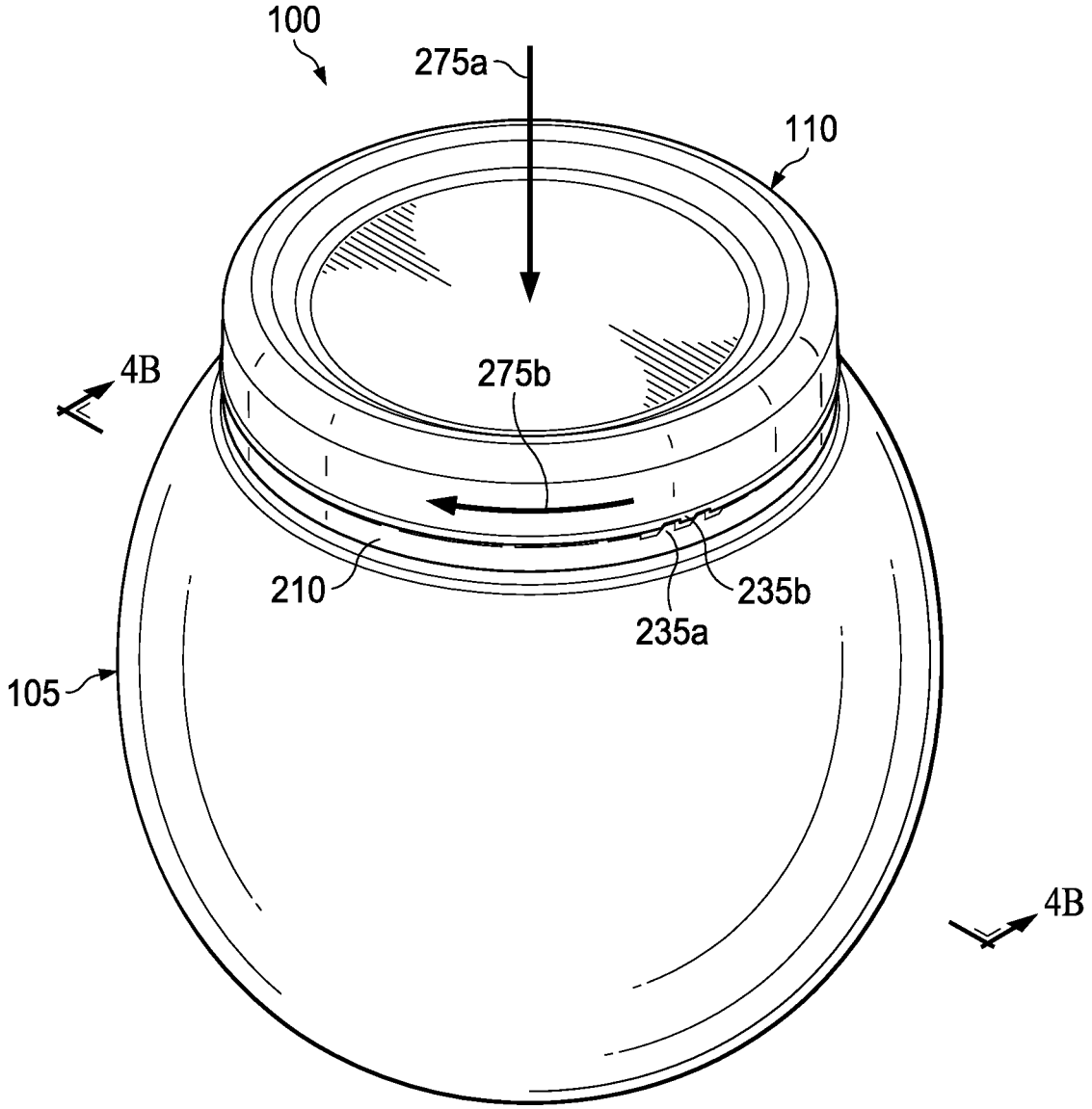
FIG. 4A is a top-front-left perspective view of the first container apparatus of FIG. 1 in a second operational state or configuration, according to one or more embodiments.
Figure 4B:
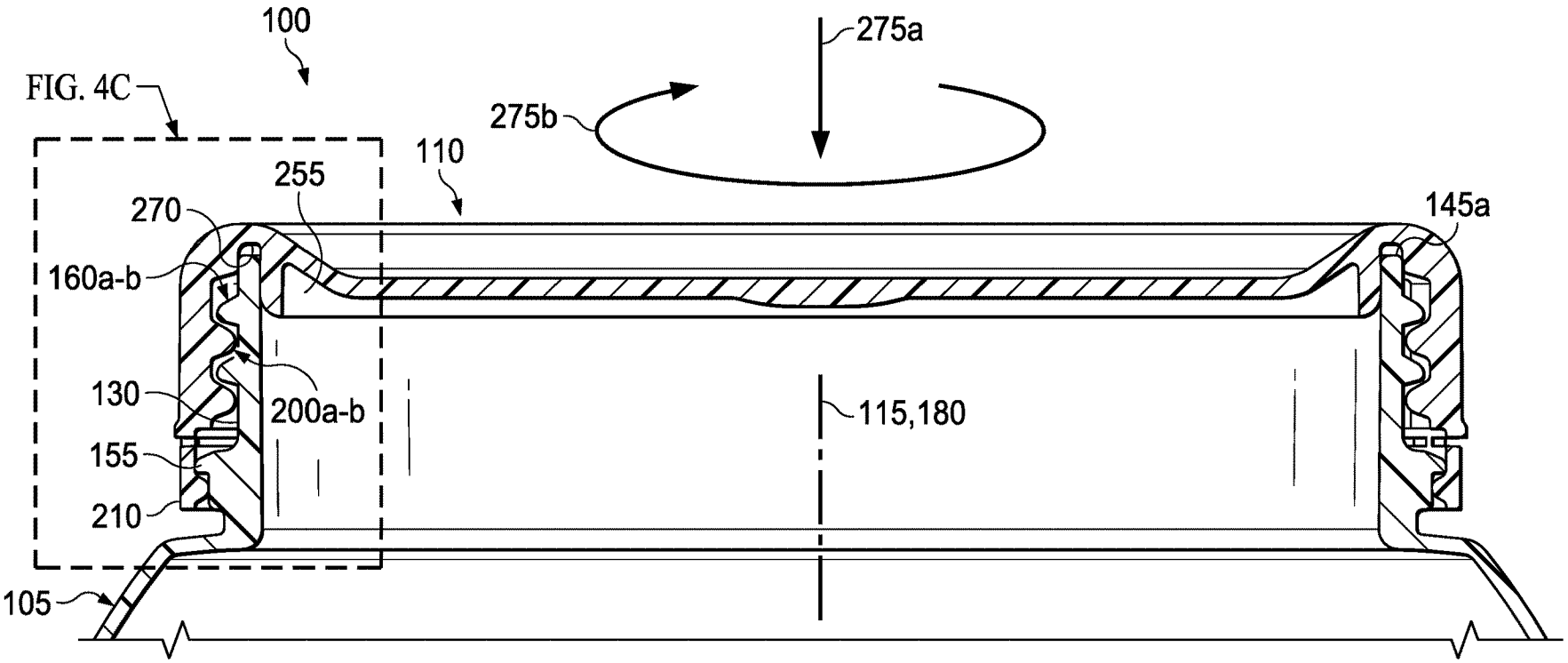
FIG. 4B is a cross-sectional view of the first container apparatus of FIG. 4A taken along the line 4B-4B of FIG. 4A, according to one or more embodiments.
Figure 4C:
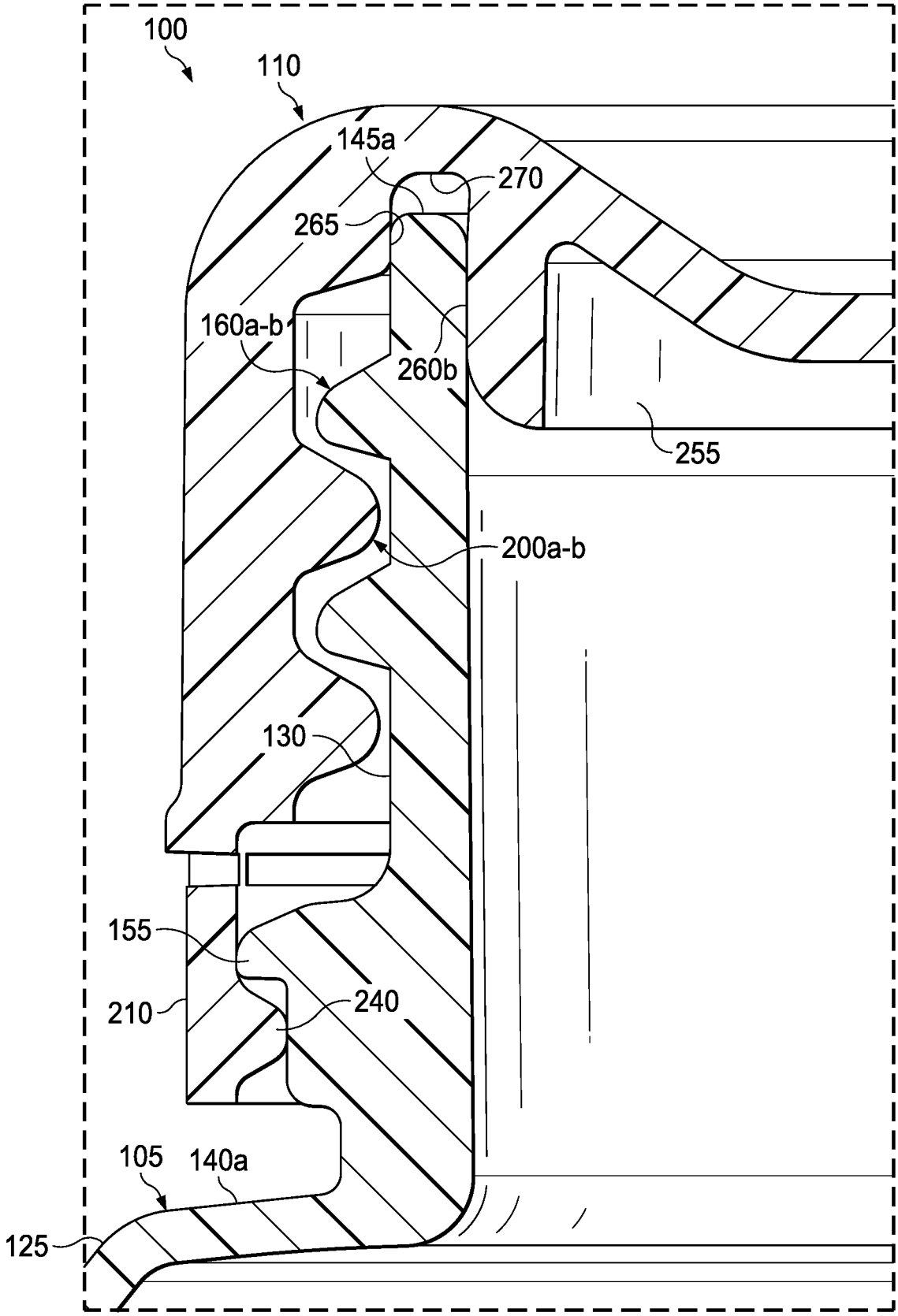
FIG. 4C is an enlarged cross-sectional view of a portion of the first container apparatus of FIG. 4B, according to one or more embodiments.
Figure 4D:
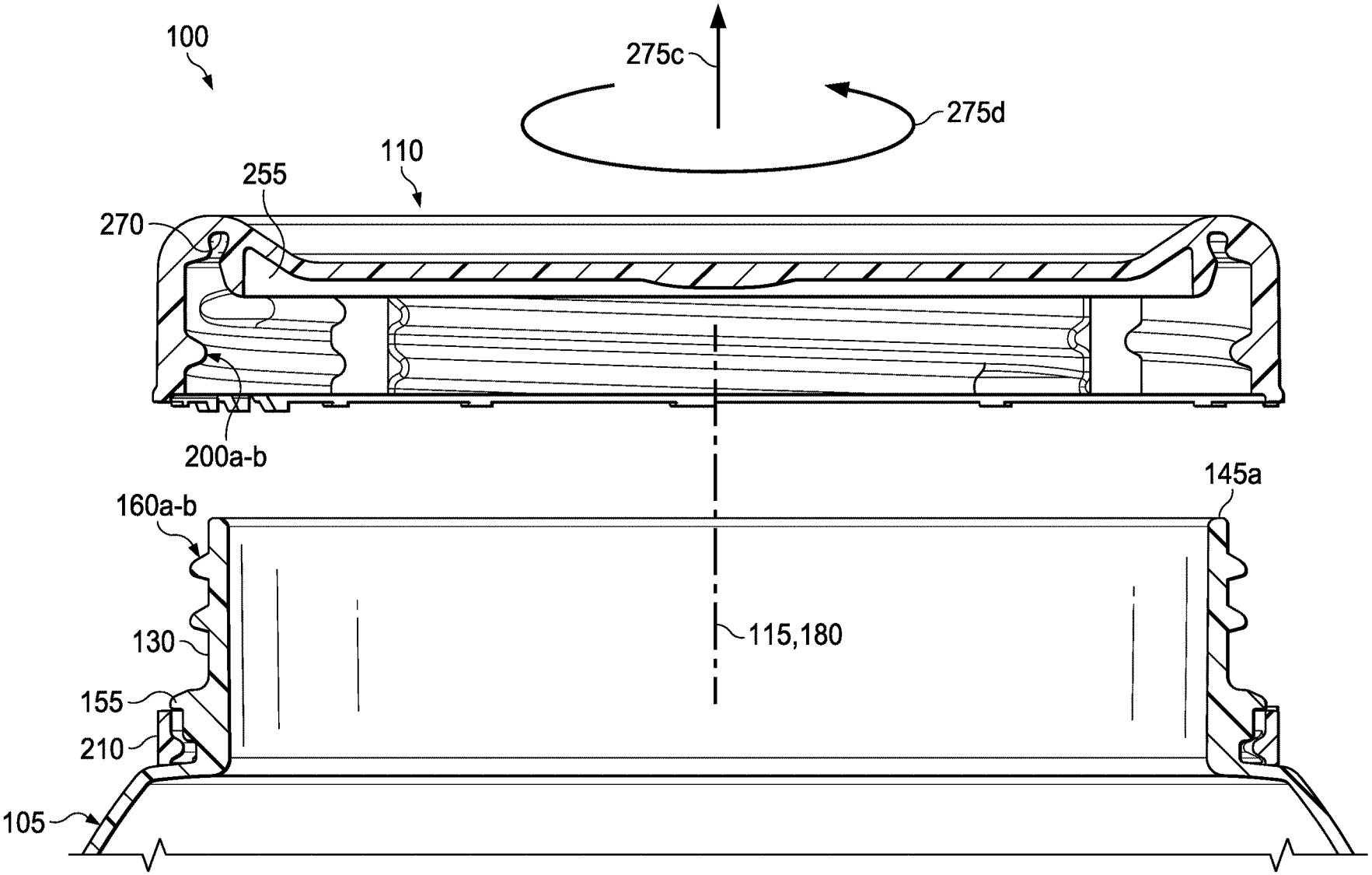
FIG. 4D is a cross-sectional view of the first container apparatus of FIG. 4A (similar to that shown in FIG. 4B) in a third operational state or configuration, according to one or more embodiments.
Figure 4E:
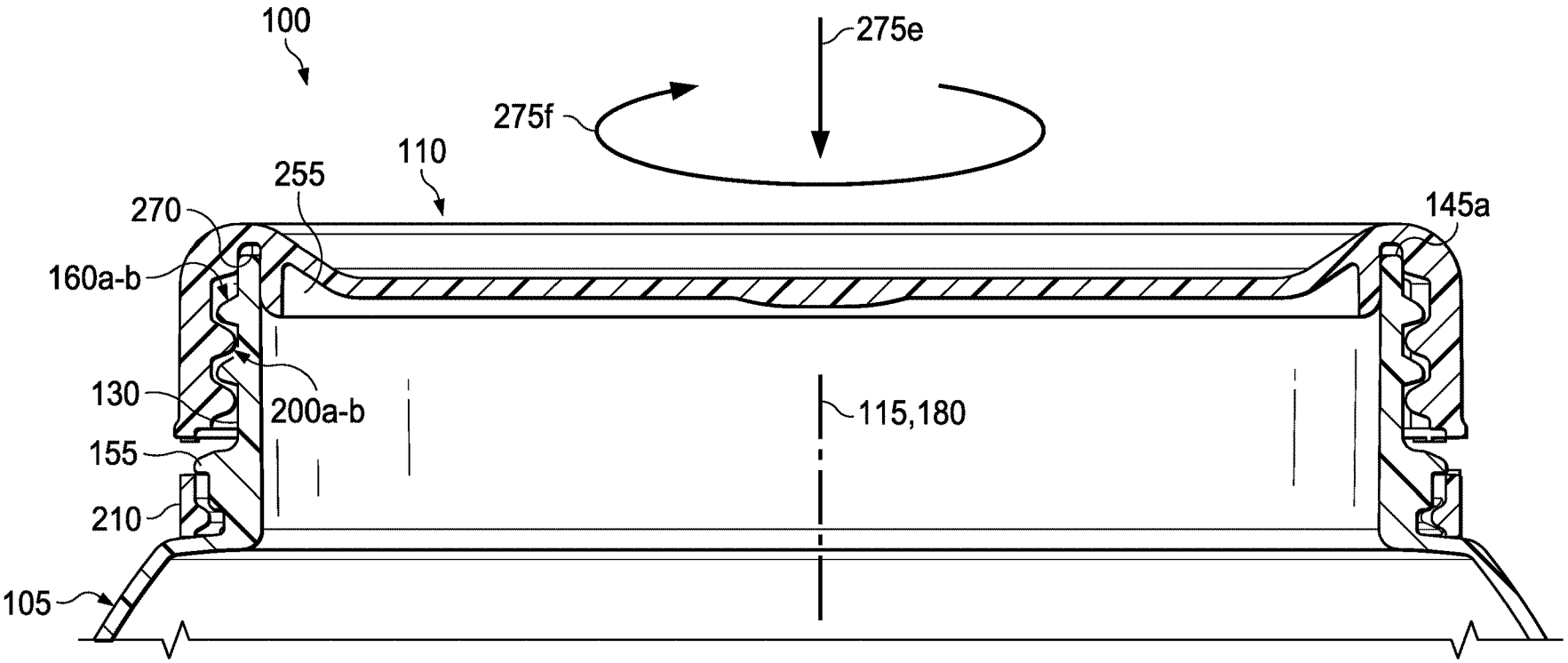
FIG. 4E is a cross-sectional view of the first container apparatus of FIG. 4A (similar to that shown in FIGS. 4B and 4D) in a fourth operational state or configuration, according to one or more embodiments.

Referring to FIGS. 4A through 4C, with continuing reference to FIGS. 1 through 3D, in an embodiment, in operation, the container lid 110 is attachable to the container body 105 by threading the container lid 110 onto the neck 130 of the container body 105, as indicated by arrows 275*a-b* in FIGS. 4A and 4B. In addition, or instead, the container lid 110 may be attachable to the container body 105 using another attachment mechanism, such as, for example, "snap-on" feature(s), locking feature(s), other attachment feature(s), the like, or any combination thereof. In any case, once so attached, the container lid 110 is detachable from, and re-attachable to, the container body 105, as shown in FIGS. 4D and 4E (and discussed in further detail below). More particularly, to attach (or re-attach) the container lid 110 to the container body 105, the end portion 145*a* of the neck 130 of the container body 105 is received within the internal region 215 of the container lid 110 so that the internal threads 200*a-b* of the container lid 110 are engaged with the external threads 160*a-b* of the container body 105. Once so engaged, the container lid 110 is rotated relative to the container body 105 so that the end portions 200*ab* and 200*bb* (shown in FIGS. 3C-1 and 3C-2) of the internal threads 200*a-b* of the container lid 110 are received under, and engaged by, the end portions 160*aa* and 160*ba* (shown in FIGS. 2C-1 and 2C-2) of the external threads 160*a-b* of the container body 105. Once the end portions 200*ab* and 200*bb* of the internal threads 200*a-b* of the container lid 110 are so received under, and engaged by, the end portions 160*aa* and 160*ba* of the external threads 160*a-b* of the container body 105, continued rotation of the container lid 110 relative to the container body 105 threads the container lid 110 onto the container body 105 via sliding engagement between internal threads 200*a-b* of the container lid 110 and the external threads 160*a-b* of the container body 105. Although shown as being threaded onto the container body 105 in the clockwise direction, in one or more embodiments, the threads of the container lid 110 and the threads of the container body 105 are instead each spirally formed in the opposite direction so that the container lid 110 threads onto the container body 105 in a counter-clockwise direction.

In some embodiments, continued threading of the container lid 110 onto the container body 105 causes an end face defined by the end portion 145*a* of the neck 130 of the container 105 to engage (e.g., sealingly) a portion of the container lid 110 defined by the internal annular groove 270. In addition, or instead, continued threading of the container lid 110 onto the container body 105 causes the internal collar 255 to move toward the end portion 145*a* of the neck 130 of the container body 105, eventually causing the end portion 145*a* of the neck 130 of the container body 105 to be received within the internal annular groove 270 of the container lid 110 so that one or both of the external bulbous protrusion 260*b* of the internal collar 255 and the internal ridge 265 of the container lid 110 engage(s) (e.g., sealingly) the end portion 145*a* of the neck 130 of the container body 105.

More particularly, in one or more embodiments, as the end portion 145*a* of the neck 130 of the container body 105 is received into the internal annular groove 270 of the container lid 110, the internal collar 255 flexes radially inwardly, thereby applying a radially-outward recoil force against the inside of the neck 130 at the end portion 145*a*, which radially-outward recoil force engages (e.g., sealingly) the external bulbous protrusion 260*b* of the internal collar 255 with the inside of the neck 130 at the end portion 145*a*. In such embodiment(s), the engagement between the external bulbous protrusion 260*b* of the internal collar 255 and the inside of the neck 130 at the end portion 145*a* facilitates (optionally, in combination with the engagement between the internal ridge 265 of the container lid 110 and the outside of the neck 130 at the end portion 145*a*, discussed below) the sealing of gas pressure within the internal cavity 120 of the container body 110 from atmosphere, even though the first ratio of the outer diameter D1 of the neck 130 to the outer diameter D2 of the side wall 125 is: greater than or equal to 1:2; greater than or equal to 1:2 and less than or equal to 7:8; greater than or equal to 1:2 and less than or equal to 3:4; greater than or equal to 2:3; greater than or equal to 2:3 and less than or equal to 7:8; or greater than or equal to 2:3 and less than or equal to 3:4.

In addition, or instead, in one or more embodiments, as the end portion 145*a* of the neck 130 of the container body 105 is received into the internal annular groove 270 of the container lid 110, the internal ridge 265 of the container lid 110 flexes radially outwardly, thereby applying a radially-inward recoil force against the outside of the neck 130 at the end portion 145*a*, which radially-inward recoil force engages (e.g., sealingly) the internal ridge 265 of the container lid 110 with the outside of the neck 130 at the end portion 145*a*. In such embodiment(s), the engagement between the internal ridge 265 of the container lid 110 and the outside of the neck 130 at the end portion 145*a* facilitates (optionally, in combination with the sealing engagement between the external bulbous protrusion 260*b* of the internal collar 255 and the inside of the neck 130 at the end portion 145*a*) the sealing of the gas pressure within the internal cavity 120 of the container body 110 from atmosphere, even though the second ratio of the inner diameter D3 of the side wall 185 of the container lid 110 to the outer diameter D2 of the side wall 125 of the container body 105 is: greater than or equal to 1:2; greater than or equal to 1:2 and less than or equal to 7:8; greater than or equal to 1:2 and less than or equal to 3:4; greater than or equal to 2:3; greater than or equal to 2:3 and less than or equal to 7:8; or greater than or equal to 2:3 and less than or equal to 3:4.

Continued threading of the container lid 110 onto the container body 105 also causes the security band 210 to move toward the external collar 155 of the container body 105, eventually causing the internal ridges 240 of the security band 210 to slide over and past the external collar 155, thereby trapping the security band 210 of the container lid 110 between the end portion 140*a* of the side wall 125 and the external collar 155 of the container body 105.

In several embodiments, a fluid, such as a beverage for human consumption, is disposed within the internal cavity 120 of the container body; in some embodiments, one or more of the above-described sealing engagements seal gas pressure within the internal cavity 120 of the container body 110 from atmosphere. In several embodiments, a fluid, such as wine such as flavored wine, is disposed within the internal cavity 120 of the container body; in some embodiments, one or more of the above-described sealing engagements seal gas pressure within the internal cavity 120 of the container body 110 from atmosphere.

Referring to FIGS. 4D and 4E, with continuing reference to FIGS. 4A through 4C, in an embodiment the trapping of the security band 210 between the end portion 140*a* of the side wall 125 and the external collar 155 of the container body 105 causes the internal ridges 140 of the security band 210 to contact the external collar 155 of the container body 105 when the container lid 110 is subsequently threaded off of the container body 105 (i.e., by rotating the container lid 110 in a direction opposite the direction 275*b* and relative to the container body 105). As a result of such threading of the container lid 110 off of the container body 105, the internal ridges 240 of the security band 210 contact the external collar 155 of the container body 105, applying a tensile force to the separable segments 230 separably connecting the container lid 110 to the security band 210. Additionally, and as a result, rotational friction between the internal ridges 240 of the security band 210 and the external collar 155 causes relative rotation between the side wall 185 of the container lid 110 and the security band 210, which relative rotation causes the ramp 235*a* of the security band 210 to be engaged by the ramp 235*b* of the side wall 185 (the ramps 235*a-b* are shown in FIGS. 3A, 3C-1, 3C-2, and 4A). Continued threading of the container lid 110 off of the container body 105 causes continued relative rotation between the side wall 185 of the container lid 110 and the security band 210 causes the ramp 235*b* of the side wall 185 to slide along the ramp 235*a* of the security band 210, thereby axially separating the container lid 110 from the security band 210 by breaking the separable segments 230 separably connecting the container lid 110 to the security band 210, as indicated by arrows 275*c-d* in FIG. 4D. Once so axially separated, the security band 210 remains axially trapped between the end portion 140*a* of the side wall 125 and the external collar 155 of the container body 105, as shown in FIG. 4D.

Additionally, when the container lid 110 is threaded off of the container body 105, the end portion 145*a* of the neck 130 is removed from the internal annular groove 270 so that the end portion 145*a* of the neck 130 is sealingly disengaged from one or both of the external bulbous protrusion 260*b* of the internal collar 255 and the internal ridge 265 of the container lid 110. This sealing disengagement of the end portion 145*a* of the neck 130 from the one or both of the external bulbous protrusion 260*b* of the internal collar 255 and the internal ridge 265 of the container lid 110 allows gas pressure within the internal cavity 120 of container body 105 to be released. More particularly, gas pressure is permitted to flow: between the internal collar 255 of the container lid 110 and the inside of the end portion 145*a* of the neck 130 of the container body 105; between the internal ridge 265 of the container lid 110 and the outside of the end portion 145*a* of the neck 130 of the container body 105; through the gaps 205*a-d* (shown in FIGS. 3B, 3C-1, and 3C-2) formed along the container lid 110; and through the gaps 165*a-d* (shown in FIGS. 2C-1, 2C-2, and 2D) formed along the container body 105. The gas pressure eventually exits to atmosphere adjacent the end portion 195*b* of the side wall 185 of the container lid 110 and the end portion 145*b* of the neck 130 of the container body 105.

In several embodiments, a fluid, such as a beverage for human consumption, is disposed within the internal cavity 120 of the container body; in some embodiments, one or more of the above-described sealing engagements seal gas pressure within the internal cavity 120 of the container body 110 from atmosphere; in several embodiments, when the container lid is detached from the container body 110, as shown in FIG. 4D, a human drinks the fluid from the internal cavity 120.

As indicated by arrows 275*e-f* in FIG. 4E, the container lid 110 can be subsequently re-attached to, and sealingly engaged with, the container body 105 in the same manner as that described above in connection with FIGS. 4A through 4C, except that the security band 210 is no longer connected to the rest of the container lid 110 (and so does not slide over and past the external collar 155, but instead remains axially trapped between the end portion 140*a* of the side wall 125 and the external collar 155 of the container body 105); therefore, the re-attachment (and sealing engagement) of the container lid 110 to the container body 105 will not be described in further detail.

In several embodiments, a fluid, such as a beverage for human consumption, is disposed within the internal cavity 120 of the container body; in some embodiments, one or more of the above-described sealing engagements seal gas pressure within the internal cavity 120 of the container body 110 from atmosphere; in several embodiments, when the container lid is detached from the container body 110, as shown in FIG. 4D, a human can drink the fluid from the internal cavity 120 via the mouth 150; in several embodiments, after drinking some of the fluid, the human reattaches the container lid 110 to the container body 105, as shown in FIG. 4E, so that the remaining (undrunk) fluid will not spill out of the internal cavity 120—in several embodiments, in the future the human again detaches the container lid 110 from the container body 105, and again drinks the fluid from the internal cavity 120 via the mouth 150.

Figure 5:
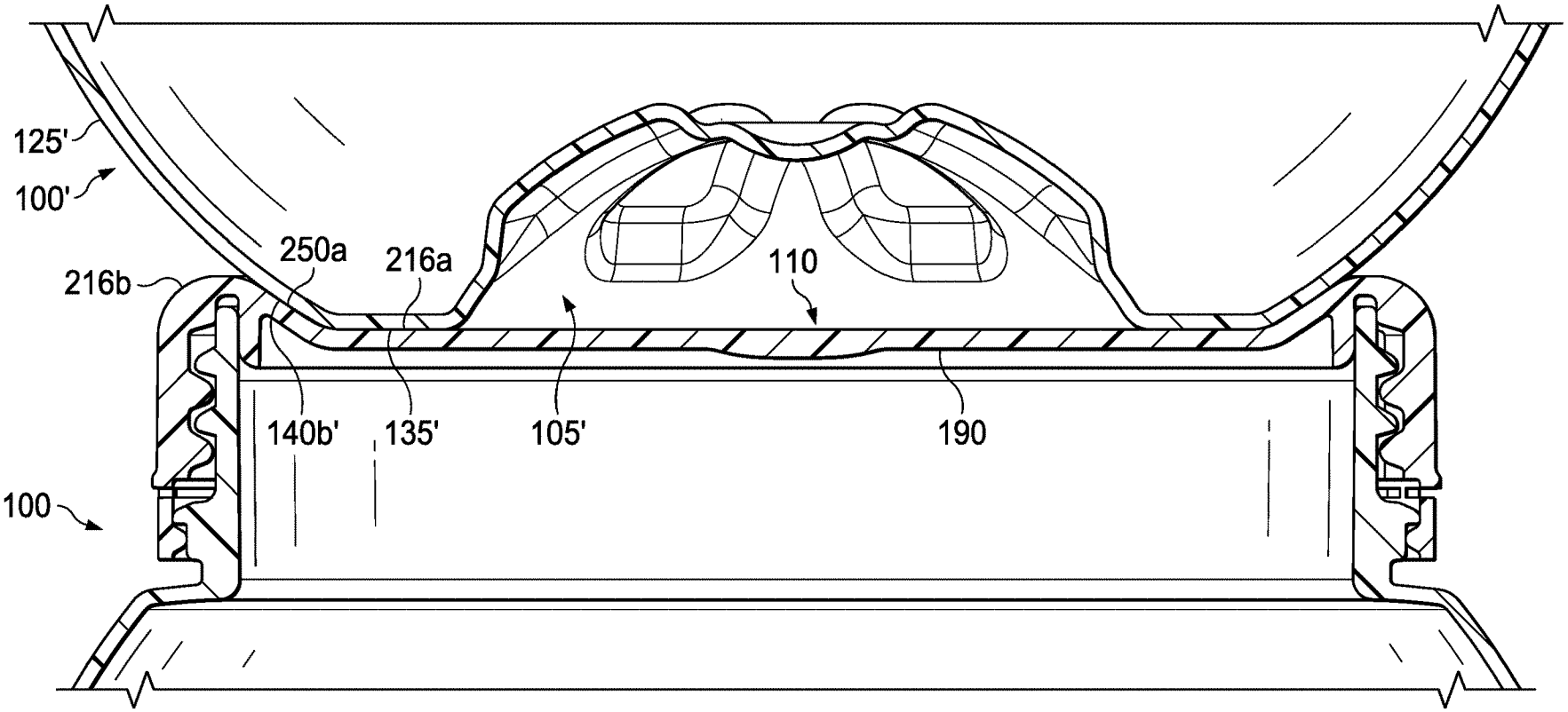
FIG. 5 is a cross-sectional view of the first container apparatus of FIG. 4A together with a second container apparatus, according to one or more embodiments.

Referring to FIG. 5, with continued reference to FIGS. 1 through 4C, in an embodiment, the container apparatus 100 is stackable with another container apparatus, which another container apparatus is substantially identical to the container apparatus 100, and, therefore, is given the same reference numeral, except with the suffix "'" added. In addition, or instead, the container apparatus 100' includes feature(s)/component(s) substantially identical to corresponding feature(s)/component(s) of the container apparatus 100', which substantially identical feature(s)/component(s) are given the same reference numerals, except with the suffix "'" added.

As shown in FIG. 5, when so stacked, a portion of the container body 105' of the container apparatus 100' matingly engages a portion of the container lid 110 of the container apparatus 100. More particularly, the bottom wall 135' of the container body 105' is matingly received by the central portion 216*a* of the top wall 190 of the container lid 110. Additionally, the end portion 140*b'* of the side wall 125' of the container body 105' is matingly received by the external surface 250*a* of the outer edge portion 216*b* of the top wall 190 of the container lid 110. For example, in those embodiment(s) in which the end portion 140*b'* of the side wall 125' of the container body 105' defines the radius of curvature R1', and the external surface 250*a* of the outer edge portion 216*b* of the top wall 190 of the container lid 110 defines the radius of curvature R2 (which is the same as the radius of curvature R1'), the end portion 140*b'* of the side wall 125' of the container body 105' matingly engages the external surface 250*a* of the outer edge portion 216*b* of the top wall 190 of the container lid 110. For another example, in those embodiment(s) in which the end portion 140*b'* of the side wall 125' of the container body 105' defines the frustoconical shape, and the external surface 250*a* of the outer edge portion 216*b* of the top wall 190 of the container lid 110 defines the frustoconical shape, the end portion 140*b'* of the side wall 125' of the container body 105' matingly engages the external surface 250*a* of the outer edge portion 216*b* of the top wall 190 of the container lid 110.

In several embodiments, one or more of the embodiments of the present application are provided in whole or in part as described and illustrated in the '332 Application, the entire disclosure of which has been incorporated herein by reference.

In several embodiments, one or more of the embodiments described and illustrated in the '332 Application are combined in whole or in part with one or more of the embodiments described above and/or one or more of the other embodiments described and illustrated in the '332 Application.

A first apparatus has been disclosed. The first apparatus generally includes: a container body defining an internal cavity, a first outer diameter, and a second outer diameter, the container body including: a first side wall surrounding the internal cavity, the first side wall defining the second outer diameter of the container body, which second outer diameter is a maximum outer diameter of the first side wall; and a neck connected to, and extending from, the first side wall, the neck defining the first outer diameter of the container body; and a container lid attached to, and sealingly engaged with, the neck of the container body; wherein the container lid is detachable from, and re-attachable to, the neck of the container body; wherein the first side wall of the container body is frustospherical or frustospheroidal; and wherein a ratio of the first outer diameter to the second outer diameter is greater than or equal to 1:2. In one or more embodiments, the container lid defines an internal region, the container lid including: a second side wall surrounding the internal region; and a top wall connected to the second side wall. In one or more embodiments, the container lid further includes an internal ridge extending inwardly and into the internal region, the internal ridge engaging an outside surface of the neck. In one or more embodiments, the container lid further includes an internal collar extending from the top wall and into the internal region, the internal collar engaging an inside surface of the neck. In one or more embodiments, the internal collar includes an external bulbous protrusion engaging the inside surface of the neck. In one or more embodiments, the container lid further includes an internal ridge extending inwardly and into the internal region, the internal ridge engaging an outside surface of the neck. In one or more embodiments, the container body defines a first three-dimensional profile at an end portion thereof opposite the neck; and the top wall of the container lid defines a second three-dimensional profile adapted to matingly receive the first three-dimensional profile of the container body. In one or more embodiments, at least a portion of the first three-dimensional profile of the container body defines a first radius of curvature; and at least a portion of the second three-dimensional profile of the container lid defines a second radius of curvature, which second radius of curvature is the same as the first radius of curvature.

A first method has also been disclosed. The first method generally includes: attaching a first container lid to a neck of a container body to sealingly engage the first container lid with the neck of the container body; wherein the first container lid is detachable from, and re-attachable to, the neck of the container body; wherein the container body defines an internal cavity, a first outer diameter, and a second outer diameter, the container body including: a first side wall surrounding the internal cavity, the first side wall defining the second outer diameter of the container body, which second outer diameter is a maximum outer diameter of the first side wall; and the neck, which is connected to, and extends from, the first side wall, the neck defining the first outer diameter of the container body; wherein the first side wall of the container body is frustospherical or frustospheroidal; and wherein a ratio of the first outer diameter to the second outer diameter is greater than or equal to 1:2. In one or more embodiments, the first container lid defines an internal region, the first container lid including: a second side wall surrounding the internal region; and a top wall connected to the second side wall. In one or more embodiments, sealingly engaging the first container lid against the neck of the container body includes engaging an internal ridge of the first container lid with an outside surface of the neck; and the internal ridge extends inwardly and into the internal region. In one or more embodiments, sealingly engaging the first container lid against the neck of the container body includes engaging an internal collar of the first container lid with an inside surface of the neck; and the internal collar extends from the top wall and into the internal region. In one or more embodiments, sealingly engaging the internal collar of the first container lid with the inside surface of the neck includes engaging an external bulbous protrusion of the internal collar with the inside surface of the neck. In one or more embodiments, sealingly engaging the first container lid against the neck of the container body further includes engaging an internal ridge of the first container lid with an outside surface of the neck; and the internal ridge extends inwardly and into the internal region. In one or more embodiments, the first method further includes: stacking the container body onto a second container lid so that a first three-dimensional profile of the second container lid matingly receives a second three-dimensional profile of the container body, which second three-dimensional profile is located at an end portion of the container body opposite the neck; wherein the second container lid is identical to the first container lid. In one or more embodiments, at least a portion of the second three-dimensional profile of the container body defines a first radius of curvature; and at least a portion of the first three-dimensional profile of the second container lid defines a second radius of curvature, which second radius of curvature is the same as the first radius of curvature.

A second apparatus has also been disclosed. The second apparatus generally includes: a container lid adapted to be attached to, and sealingly engaged with, a container body, the container lid defining an internal region and an inner diameter, and the container lid including: a first side wall surrounding the internal region, the first side wall defining the inner diameter of the container lid; a top wall connected to the first side wall; and an internal collar extending from the top wall and into the internal region, the internal collar including an external bulbous protrusion adapted to engage an inside surface of the container body; and the container body; wherein, after the container lid is attached to, and sealingly engaged with, the container body, the container lid is detachable from, and re-attachable to, the container body.

In one or more embodiments, the container lid further includes an internal ridge extending inwardly and into the internal region, the internal ridge being adapted to engage an outside surface of the container body. In one or more embodiments, the container body defines an internal cavity and an outer diameter, the container body including: a second side wall surrounding the internal cavity, the second side wall defining the outer diameter of the container body, which outer diameter is a maximum outer diameter of the second side wall; and a neck connected to, and extending from, the second side wall; and the container lid is adapted to seal against the neck of the container body. In one or more embodiments, the second side wall of the container body is frustospherical or frustospheroidal. In one or more embodiments, a ratio of the inner diameter of the container lid to the outer diameter of the container body is greater than or equal to 1:2. In one or more embodiments, the container body defines a first three-dimensional profile at an end portion thereof opposite the neck; and the top wall of the container lid defines a second three-dimensional profile adapted to matingly receive the first three-dimensional profile of the container body. In one or more embodiments, at least a portion of the first three-dimensional profile of the container body defines a first radius of curvature; and at least a portion of the second three-dimensional profile of the container lid defines a second radius of curvature, which second radius of curvature is the same as the first radius of curvature.

A second method has also been disclosed. The second method generally includes: attaching a first container lid to a container body to sealingly engage the first container lid with the container body, the first container lid defining an internal region and an inner diameter, and the first container lid including: a first side wall surrounding the internal region, the first side wall defining the inner diameter of the first container lid; a top wall connected to the first side wall; and an internal collar extending from the top wall and into the internal region, the internal collar including an external bulbous protrusion; wherein the first container lid is detachable from, and re-attachable to, the container body; and wherein sealingly engaging the first container lid against the container body includes engaging the external bulbous protrusion with an inside surface of the container body. In one or more embodiments, sealingly engaging the first container lid against the container body further includes engaging an internal ridge of the first container lid with an outside surface of the neck; and the internal ridge extends inwardly and into the internal region. In one or more embodiments, sealingly engaging the first container lid against the container body includes sealingly engaging the first container lid against a neck of the container body; and the container body defines the internal cavity and an outer diameter, the container body including: a second side wall surrounding the internal cavity, the second side wall defining the outer diameter of the container body, which outer diameter is a maximum outer diameter of the second side wall; and the neck, which is connected to, and extends from, the second side wall. In one or more embodiments, the second side wall of the container body is frustospherical or frustospheroidal. In one or more embodiments, a ratio of the inner diameter of the first container lid to the outer diameter of the container body is greater than or equal to 1:2. In one or more embodiments, the second method further includes: stacking the container body onto a second container lid so that a first three-dimensional profile of the second container lid matingly receives a second three-dimensional profile of the container body, which second three-dimensional profile is located at an end portion of the container body opposite the neck; wherein the second container lid is identical to the first container lid. In one or more embodiments, at least a portion of the second three-dimensional profile of the container body defines a first radius of curvature; and at least a portion of the first three-dimensional profile of the second container lid defines a second radius of curvature, which second radius of curvature is the same as the first radius of curvature.

It is understood that variations may be made in the foregoing without departing from the scope of the disclosure.

In one or more embodiments, the elements and teachings of the various illustrative embodiments may be combined in whole or in part in some or all of the illustrative embodiments. In addition, one or more of the elements and teachings of the various illustrative embodiments may be omitted, at least in part, or combined, at least in part, with one or more of the other elements and teachings of the various illustrative embodiments.

Any spatial references such as, for example, "upper," "lower," "above," "below," "between," "bottom," "vertical," "horizontal," "angular," "upwards," "downwards," "side-to-side," "left-to-right," "left," "right," "right-to-left," "top-to-bottom," "bottom-to-top," "top," "bottom," "bottom-up," "top-down," etc., are for the purpose of illustration only and do not limit the specific orientation or location of the structure described above.

In one or more embodiments, while different steps, processes, and procedures are described as appearing as distinct acts, one or more of the steps, one or more of the processes, or one or more of the procedures may also be performed in different orders, simultaneously or sequentially. In one or more embodiments, the steps, processes or procedures may be merged into one or more steps, processes or procedures. In one or more embodiments, one or more of the operational steps in each embodiment may be omitted. Moreover, in some instances, some features of the present disclosure may be employed without a corresponding use of the other features. Moreover, one or more of the embodiments disclosed above and in the '332 Application, or variations thereof, may be combined in whole or in part with any one or more of the other embodiments described above and in the '332 Application, or variations thereof.

Although one or more embodiments have been disclosed in detail above and in the '332 Application, the embodiments disclosed are exemplary only and are not limiting, and those skilled in the art will readily appreciate that many other modifications, changes, and substitutions are possible in the embodiments without materially departing from the novel teachings and advantages of the present disclosure. Accordingly, all such modifications, changes, and substitutions are intended to be included within the scope of this disclosure as defined in the following claims. In the claims, means-plus-function clauses are intended to cover the structures described herein as performing the recited function and not only structural equivalents, but also equivalent structures. Moreover, it is the express intention of the applicant not to invoke 35 U.S.C. § 112(f) for any limitations of any of the claims herein, except for those in which the claim expressly uses the word "means" together with an associated function.

What is claimed is:

1. An apparatus, comprising:

a container body defining an internal cavity, a first outer diameter, and a second outer diameter, the container body comprising:

a first side wall surrounding the internal cavity, the first side wall defining the second outer diameter of the container body, which second outer diameter is a maximum outer diameter of the first side wall, the first side wall further defining axially-opposing first and second end portions;

a neck connected to, and extending from, the first side wall at the first end portion, the neck defining the first outer diameter of the container body; and a bottom wall connected to, and extending from, the first side wall at the second end portion, opposite the neck;

and a container lid attached to, and sealingly engaged with, the neck of the container body, the container lid comprising:

a second side wall;

a top wall connected to the second side wall;

wherein the second side wall and the top wall, in combination, define an internal region of the container lid;

wherein the container lid further comprises:

an internal ridge extending inwardly and into the internal region, the internal ridge engaging an outside surface of the neck; and an internal collar extending from the top wall and into the internal region, the internal collar engaging an inside surface of the neck;

wherein the top wall comprises a central portion and an outer edge portion connecting the central portion to the second side wall;

wherein the outer edge portion comprises a radially-inwardly-facing external surface adjoining the central portion;

wherein the radially-inwardly-facing external surface and the central portion, in combination, define an external concavity of the container lid, opposite the internal region;

wherein the container lid is detachable from, and re-attachable to, the neck of the container body;

wherein at least part of the second end portion of the first side wall adjoins at least part of the bottom wall so that, in combination, the adjoining parts of the first side wall and the bottom wall define a first contiguous three-dimensional profile of the container body;

wherein at least part of the radially-inwardly-facing external surface adjoins at least part of the central portion so that, in combination, the adjoining parts of the radially-inwardly-facing external surface and the central portion define a second contiguous three-dimensional profile of the container lid;

wherein, when the container lid is detached from the neck of the container body, the second contiguous three-dimensional profile of the container lid is adapted to matingly receive the first contiguous three-dimensional profile of the container body so that:

the bottom wall of the container body engages the central portion of the top wall of the container lid; and the second end portion of the first side wall of the container body engages the radially-inwardly-facing external surface of the top wall of the container lid;

wherein the first side wall of the container body is frustospherical or frustospheroidal; and wherein a ratio of the first outer diameter to the second outer diameter is greater than or equal to 2:3.

2. The apparatus of claim 1, wherein the internal collar includes an external bulbous protrusion engaging the inside surface of the neck.

3. The apparatus of claim 1, wherein at least a portion of the first contiguous three-dimensional profile of the container body defines a first radius of curvature; and wherein at least a portion of the second contiguous three-dimensional profile of the container lid defines a second radius of curvature, which second radius of curvature is the same as the first radius of curvature.

4. The apparatus of claim 1, wherein external threads extend circumferentially around an outside surface of the neck.

5. The apparatus of claim 1, wherein internal threads extend circumferentially around an inside surface of the second side wall of the container lid.

6. The apparatus of claim 5, wherein external threads extend circumferentially around an outside surface of the neck.

7. The apparatus of claim 6, wherein the sealing engagement of the container lid and the neck comprises engagement of the internal threads of the container lid with the external threads of the neck of the container body.

8. The apparatus of claim 1, further comprising a security band trapped between the first side wall of the container body and an external collar, the external collar extending circumferentially around, and radially outward from, the neck.

9. The apparatus of claim 8, wherein the security band is detachably connected to the second side wall at the end of the second side wall opposite the top wall.

10. The apparatus of claim 1, wherein the central portion of the top wall of the container lid is planar.

11. A method, comprising:

attaching a first container lid to a neck of a container body to sealingly engage the first container lid with the neck of the container body; and stacking the container body onto a second container lid so that a first contiguous three-dimensional profile of the second container lid matingly receives a second contiguous three-dimensional profile of the container body, the second container lid being identical to the first container lid;

wherein the first container lid is detachable from, and re-attachable to, the neck of the container body;

wherein the container body defines an internal cavity, a first outer diameter, and a second outer diameter, the container body comprising:

a first side wall surrounding the internal cavity, the first side wall defining the second outer diameter of the container body, which second outer diameter is a maximum outer diameter of the first side wall, the first side wall further defining axially-opposing first and second end portions;

the neck, which is connected to, and extends from, the first side wall, the neck defining the first outer diameter of the container body; and a bottom wall connected to, and extending from, the first side wall at the second end portion, opposite the neck;

wherein the first and second container lids each comprise:

a second side wall;

a top wall connected to the second side wall so that, in combination, the second side wall and the top wall define an internal region, the top wall comprising a central portion and an outer edge portion connecting the central portion to the second side wall, the outer edge portion comprising a radially-inwardly-facing external surface adjoining the central portion, the radially-inwardly-facing external surface and the central portion, in combination, defining an external concavity, opposite the internal region, and at least part of the radially-inwardly-facing external surface adjoining at least part of the central portion;

an internal ridge extending into the internal region; and an internal collar extending from the top wall and into the internal region;

wherein attaching the first container lid to the neck of the container body to sealingly engage the first container lid with the neck of the container body comprises:

engaging the internal ridge of the first container lid with an outside surface of the neck; and engaging the internal collar of the first container lid with an inside surface of the neck;

wherein, in combination, the adjoining parts of the radially-inwardly-facing external surface and the central portion of the second container body define the first contiguous three-dimensional profile of the second container lid;

wherein at least part of the second end portion of the first side wall adjoins at least part of the bottom wall so that, in combination, the adjoining parts of the first side wall and the bottom wall define the second contiguous three-dimensional profile of the container body;

wherein stacking the container body onto the second container lid so that the first contiguous three-dimensional profile of the second container lid matingly receives the second contiguous three-dimensional profile of the container body comprises:

engaging the bottom wall of the container body with the central portion of the top wall of the second container lid; and engaging the second end portion of the first side wall of the container body with the radially-inwardly-facing external surface of the top wall of the second container lid;

wherein the first side wall of the container body is frustospherical or frustospheroidal; and wherein a ratio of the first outer diameter to the second outer diameter is greater than or equal to 2:3.

12. The method of claim 11, wherein engaging the internal collar of the first container lid with the inside surface of the neck comprises engaging an external bulbous protrusion of the internal collar of the first container lid with the inside surface of the neck.

13. The method of claim 11, wherein at least a portion of the second contiguous three-dimensional profile of the container body defines a first radius of curvature; and wherein at least a portion of the first contiguous three-dimensional profile of the second container lid defines a second radius of curvature, which second radius of curvature is the same as the first radius of curvature.

14. The method of claim 11, wherein internal threads extend circumferentially around an inside surface of the second side wall of the container lid, the internal threads defining circumferentially opposing and axially spaced end portions; and wherein external threads extend circumferentially around an outside surface of the neck, the external threads defining circumferentially opposing and axially spaced end portions.

15. The method of claim 14, further comprising:

engaging the end portion of the internal threads of the container lid furthest from the top wall under the end portion of the external threads of the neck furthest from the first side wall; and rotating the container lid relative to the container body to thread the container lid onto the container body.

16. The method of claim 11, wherein the central portion of the top wall of the second container lid is planar.

* * * * *